US012747079B2

(12) United States Patent
Garnier et al.

(10) Patent No.: US 12,747,079 B2
(45) Date of Patent: Sep. 29, 2026

(54) ARTICLE CARRIER AND BLANK THEREFOR

(71) Applicant: WestRock Packaging Systems, LLC, Atlanta, GA (US)

(72) Inventors: Jean-Michel Garnier, Issoudun (FR); Phillippe Derouault, Paris (FR); Kenneth C. Smith, Marietta, GA (US); Jonathan Lyon, Joliet, IL (US); Jeffrey S. James, Elmhurst, IL (US); Matthew E. Zacherle, Moseley, VA (US); Emma Wingerd, Richmond, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 18/835,284

(22) PCT Filed: Feb. 2, 2023

(86) PCT No.: PCT/US2023/061814

§ 371 (c)(1),
(2) Date: Aug. 1, 2024

(87) PCT Pub. No.: WO2023/150594

PCT Pub. Date: Aug. 10, 2023

(65) Prior Publication Data

US 2025/0162777 A1 May 22, 2025

Related U.S. Application Data

(60) Provisional application No. 63/327,489, filed on Apr. 5, 2022, provisional application No. 63/305,704, filed on Feb. 2, 2022.

(51) Int. Cl.
*B65D 71/42* (2006.01)

(52) U.S. Cl.
CPC ..... *B65D 71/42* (2013.01); *B65D 2571/0029* (2013.01); *B65D 2571/00444* (2013.01); *B65D 2571/0066* (2013.01)

(58) Field of Classification Search
CPC ..... B65D 71/42; B65D 71/504; B65D 2571/0029; B65D 2571/00444; B65D 2571/0066
(Continued)

(56) References Cited

U.S. PATENT DOCUMENTS 4,190,149 A 2/1980 Oliff
4,304,329 A 12/1981 Graser
(Continued)

FOREIGN PATENT DOCUMENTS

EP 0428354 A1 5/1991

OTHER PUBLICATIONS

PCTUS2361814 International Search Report dated Jun. 15, 2023, 4 pages.

*Primary Examiner* — Bryon P Gehman
(74) *Attorney, Agent, or Firm* — Brian J. Goldberg; Rohini K. Garg; Tsugihiko Suzuki

(57) ABSTRACT

Aspects of the disclosure relate to a package, an article carrier (90; 190; 290; 390; 490) for packaging one or more articles (B) and a blank (10; 110; 210; 310; 410) for forming the carrier. The article carrier (90; 190; 290; 390; 490) comprising a top panel (12; 112; 212; 312; 412) and a skirt structure surrounding and extending from the top panel (12; 112; 212; 312; 412). The skirt structure comprises a plurality of panels (14, 16, 18, 20, 24A, 24B, 28A, 28B; 114A, 114B, 116A, 116B, 118A, 118B, 120A, 120B, 124A, 124B, 128A, 128B; 214, 216, 218, 220; 314, 316, 318, 320, 324A, 324B, 328A, 328B; 414A, 414B, 416A, 416B, 418A, 418B, 420A, 420B, 424A, 424B, 428A, 428B) which include at least a
(Continued)

first pair of opposing panels ($P_{A1}$, $P_{B1}$, $P_{A2}$, $P_{B2}$). The plurality of panels (14, 16, 18, 20, 24A, 24B, 28A, 28B; 114A, 114B, 116A, 116B, 118A, 118B, 120A, 120B, 124A, 124B, 128A, 128B; 214, 216, 218, 220; 314, 316, 318, 320, 324A, 324B, 328A, 328B; 414A, 414B, 416A, 416B, 418A, 418B, 420A, 420B, 424A, 424B, 428A, 428B) are connected together such that the skirt structure provides a continuous loop for surrounding a group of articles to bundle the articles (B) of the group together. The skirt structure has a pre-loading form before application to the group of articles and a post-loading form in which articles are received by the skirt structure. The skirt structure in the pre-loading form has a first pre-loading dimension or length ($L_1$) measured between distal ends of the opposing panels ($P_{A1}$, $P_{B1}$). The skirt structure in the post-loading form has a first post-loading length ($L_2$) measured between the distal ends of the opposing panels ($P_{A2}$, $P_{B2}$). The post-loading form differs from the pre-loading form such that the first post-loading length ($L_2$) is greater than the first pre-loading length ($L_1$).

13 Claims, 15 Drawing Sheets

(58) Field of Classification Search
USPC ..... 206/148
See application file for complete search history.

(56) References Cited

U.S. PATENT DOCUMENTS 4,465,180 A * 8/1984 Klygis ..... B65D 71/504
294/87.2
5,960,945 A 10/1999 Sutherland

* cited by examiner

ARTICLE CARRIER AND BLANK THEREFOR

TECHNICAL FIELD

The present invention relates to article carriers and to blanks for forming the same. More specifically, but not exclusively, the invention relates to a carrier of the top-gripping type having one or more apertures for receiving and retaining an article therein.

BACKGROUND

In the field of packaging, it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said panel and are arranged about the aperture. The tabs are displaced out of the plane of said panel when an article is received in the aperture, wherein said tabs engage the article generally about a flange or lip of the article. The present invention seeks to provide an improvement in the field of cartons, typically formed from paperboard or the like.

SUMMARY

A first aspect of the invention provides an article carrier for packaging one or more articles. The article carrier comprises a main panel and a skirt structure surrounding and extending from the main panel. The skirt structure comprises a plurality of panels including at least a first pair of opposing panels. The plurality of panels is connected together such that the skirt structure provides a continuous loop for surrounding a group of articles to bundle the articles of the group together. The pair of opposing panels extend from the main panel to respective distal ends thereof such that the opposing panels diverge away from each other as they extend away from the main panel. The skirt structure has a pre-loading form before application to the group of articles and a post-loading form, after loading with articles, in which the articles are received by the skirt structure. The skirt structure in the pre-loading form has a first pre-loading dimension or length $L_1$ measured between distal ends of the opposing panels. The skirt structure in the post-loading form has a first post-loading length $L_2$ measured between the distal ends of the opposing panels. The post-loading form differs from the pre-loading form such that the first post-loading length $L_2$ is greater than the first pre-loading length $L_1$.

Optionally, the plurality of panels includes a pair of opposing end panels and a pair of opposing side panels, wherein the opposing panels of the first pair comprises the opposing end panels.

Optionally, the plurality of panels includes a pair of opposing end panels, a pair of opposing side panels and at least one pair of diagonally opposing corner panels, optionally two pairs of diagonally opposing corner panels, wherein the opposing panels of the first pair comprise the at least one pair of diagonally opposing corner panels.

Optionally, the plurality of panels includes a second pair of opposing panels, the panels of the second pair of opposing panels extend from the main panel to respective distal ends thereof such that the panels of the second pair of opposing panels diverge away from each other as they extend away from the main panel. The skirt structure in the pre-loading form has a second pre-loading length measured between the distal ends of the second pair of opposing panels, the skirt structure in the post-loading form has a second post-loading length measured between the distal ends of the second pair of opposing panels. The post-loading form differs from the pre-loading form such that the first and second post-loading lengths are greater than the first and second pre-loading lengths respectively.

A second aspect of the invention provides a blank for forming an article carrier. The blank comprises a main panel and a plurality of panels for forming a skirt structure extending from the main panel for surrounding the main panel in a setup condition. The plurality of panels is configured to be connected together such that the skirt structure provides a continuous loop for surrounding a group of articles to bundle or encourage the articles of the group together. The skirt structure includes at least a first pair of opposing panels extending from the main panel to respective distal ends thereof. In a setup condition, the opposing panels diverge away from each other as they extend away from the main panel. The skirt structure has a pre-loading form before, application to the group of articles, and a post-loading form, after application to a group of articles, in which the articles are received by the skirt structure. The skirt structure in the pre-loading form has a first pre-loading dimension or length $L_1$ measured between distal ends of the opposing panels. The skirt structure in the post-loading form has a first post-loading length $L_2$ measured between the distal ends of the opposing panels. The post-loading form differs from the pre-loading form such that the first post-loading length $L_2$ is greater than the first pre-loading length $L_1$.

A third aspect of the invention provides an article carrier for packaging one or more articles. The article carrier comprises a main panel and a skirt structure surrounding and extending from the main panel. The skirt structure comprises a plurality of panels connected together such that the skirt structure provides a continuous loop for surrounding a group of articles to bundle the articles of the group together. The plurality of panels comprises at least a pair of opposing upper panels and at least a first pair of opposing lower panels. The opposing upper panels extend from the main panel such that the opposing upper panels diverge away from each other as they extend away from the main panel. The first pair of opposing lower panels are connected to the opposing upper panels such that the first pair of opposing lower panels extend to respective distal ends thereof. The skirt structure has a pre-loading form, before application to the group of articles, and a post-loading form, after loading with articles, in which the articles are received by the skirt structure. The skirt structure in the pre-loading form has a first pre-loading length $L_1$ measured between distal ends of the opposing lower panels, and wherein the skirt structure in the post-loading form has a first post-loading length $L_2$ measured between the distal ends of the opposing lower panels, the post-loading form differs from the pre-loading form such that the first post-loading length $L_2$ is greater than the first pre-loading length $L_1$.

Optionally, the plurality of panels includes a pair of opposing lower end panels and a pair of opposing lower side panels, the lower side panels and the lower end panels being connected to the at least a pair of opposing upper panels wherein the opposing lower panels of the first pair comprise the opposing lower end panels.

Optionally, the plurality of panels includes a pair of opposing lower end panels, a pair of opposing lower side panels and at least one pair of diagonally opposing corner panels, wherein the opposing lower panels of the first pair comprise the at least one pair of diagonally opposing corner panels.

A fourth aspect of the invention provides a blank for forming an article carrier. The blank comprises a main panel and a plurality of panels for forming a skirt structure extending from the main panel for surrounding the main panel in a setup condition. The plurality of panels is configured to be connected together such that the skirt structure provides a continuous loop for surrounding a group of articles to bundle the articles of the group together. The plurality of panels comprises at least a pair of opposing upper panels and at least a first pair of opposing lower panels. The opposing upper panels extend from the main panel such that the opposing upper panels diverge away from each other as they extend away from the main panel. The first pair of opposing lower panels are connected to the opposing upper panels such that the first pair of opposing lower panels extend to respective distal ends thereof. The skirt structure has a pre-loading form, before application to the group of articles, and a post-loading form, after loading with articles, in which the articles are received by the skirt structure. The skirt structure in the pre-loading form has a first pre-loading length $L_1$ measured between distal ends of the opposing lower panels. The skirt structure in the post-loading form has a first post-loading length $L_2$ measured between the distal ends of the opposing lower panels. The post-loading form differs from the pre-loading form such that the first post-loading length $L_2$ is greater than the first pre-loading length $L_1$.

Further features and advantages of the present invention will be apparent from the specific embodiments illustrated in the drawings and discussed below.

Within the scope of this application, it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
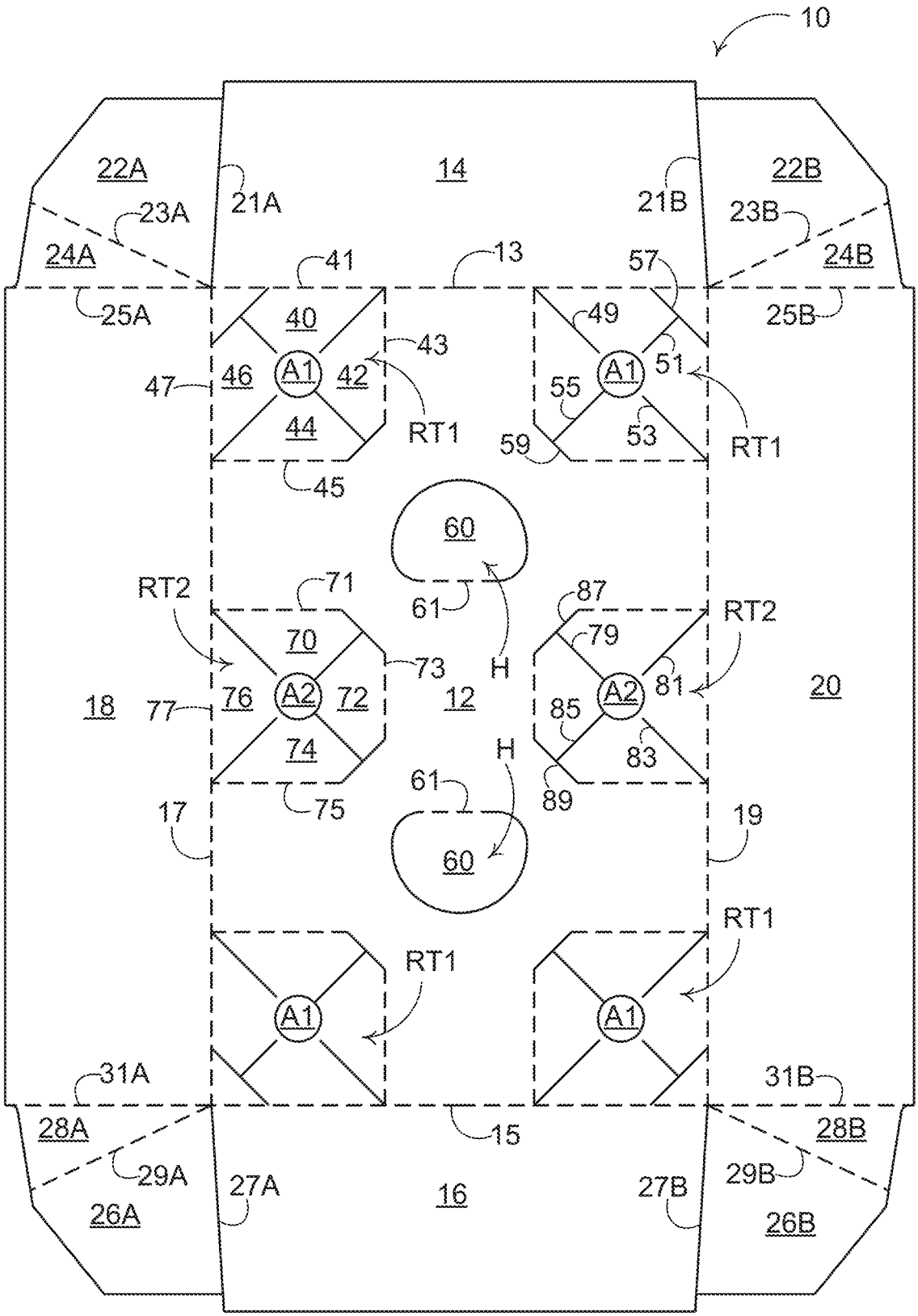
FIG. 1 is a plan view from above of a blank for forming a carrier according to a first embodiment.
Figure 2:
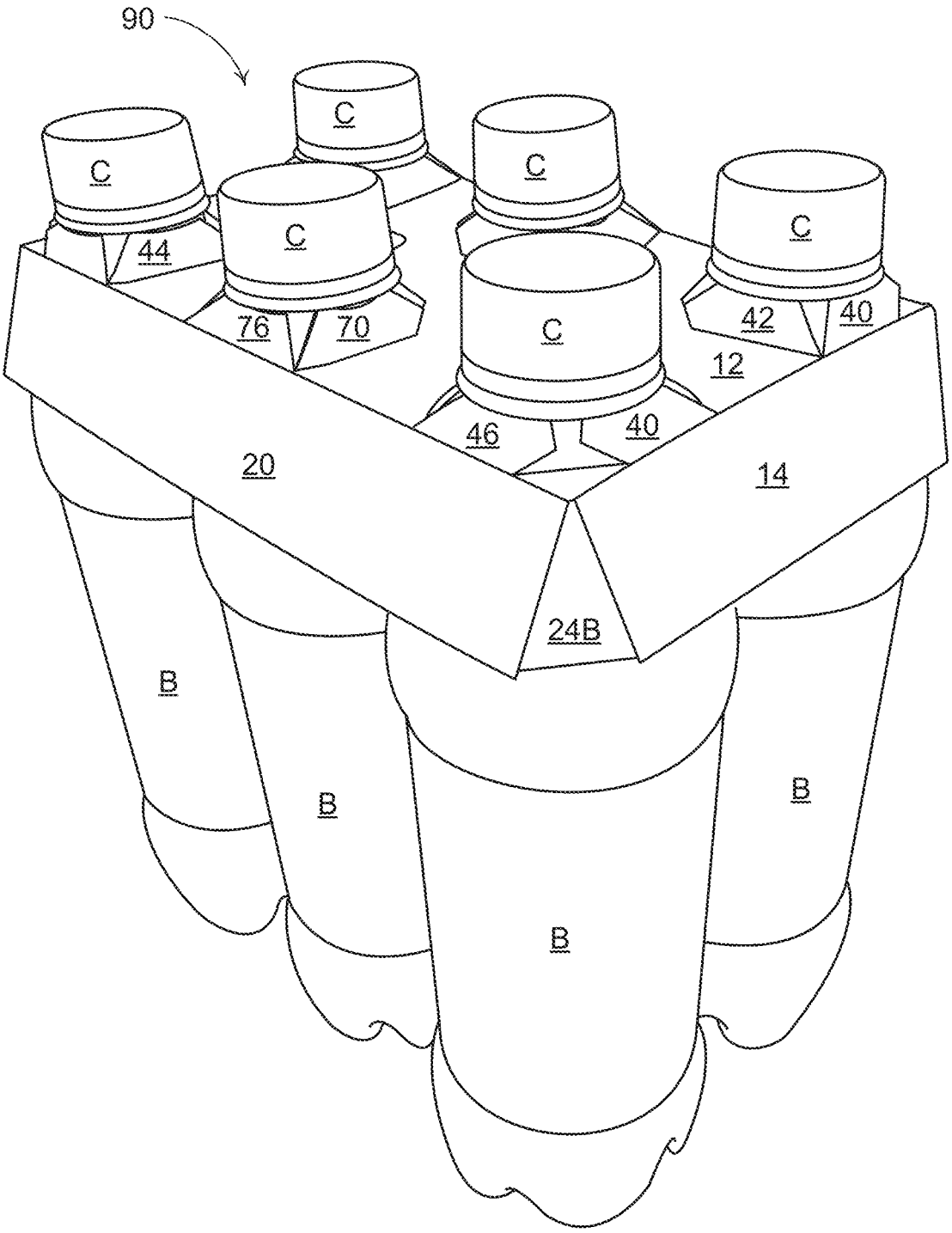
FIG. 2 is a perspective view from above of a carrier formed from the blank of FIG. 1.

Referring to FIG. 1, there is shown a plan view of a blank 10 which is capable of forming a carton or carrier 90, as shown in FIG. 2, for containing and carrying a group of primary products such as, but not limited to, bottles or cans, hereinafter referred to as articles B. The blank 10 forms a secondary package for packaging at least one primary product container or package.

Alternative blanks 110; 210; 310; 410 are shown in FIGS. 3, 5, 7, and 11 for forming a carton or carrier 190; 290; 390; 490, as shown in FIGS. 4, 6, 8, and 12, for containing and carrying a group of primary products such as, but not limited to, bottles or cans, hereinafter referred to as articles B.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10; 110; 210; 310; 410 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures or cartons 90; 190; 290; 390; 490 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10; 110; 210; 310; 410 are configured to form a carton or carrier 90; 190; 290; 390; 490 for packaging an exemplary arrangement of exemplary articles B. In the illustrated embodiments, the arrangement is a 2×3 matrix or array; in the illustrated embodiments two rows of three articles B are provided, and the articles B are 500 ml PET bottles.

Alternatively, the blanks 10; 110; 210; 310; 410 can be configured to form a carrier for packaging other types, number and size of articles and/or for packaging articles in a different arrangement or configuration.

Referring to FIG. 1 there is shown a blank 10 comprising a plurality of panels 12, 14, 16, 18, 20, including a main panel 12 for forming a top wall or engaging panel of a carrier 90 (see FIG. 2).

A first end panel 14 is hingedly connected to a first end of the main panel 12 by a hinged connection in the form of a fold line 13.

A second end panel 16 is hingedly connected to a second end of the main panel 12 by a hinged connection in the form of a fold line 15.

A first side panel 18 is hingedly connected to a first side of the main panel 12 by a hinged connection in the form of a fold line 17.

A second side panel 20 is hingedly connected to a second side of the main panel 12 by a hinged connection in the form of a fold line 19.

A first corner panel 24A is hingedly connected to a first end of the first side panel 18 by a hinged connection in the form of a fold line 25A. A second corner panel 24B is hingedly connected to a first end of the second side panel 20 by a hinged connection in the form of a fold line 25B.

A first securing panel 22A is hingedly connected to the first corner panel 24A by a hinged connection in the form of a fold line 23A. The first securing panel 22A is separated from the first end panel 14 by a cut line or severable line 21A.

A second securing panel 22B is hingedly connected to the second corner panel 24B by a hinged connection in the form of a fold line 23B. The first securing panel 22A is separated from the first end panel 14 by a cut line or severable line 21B.

A third corner panel 28A is hingedly connected to a second end of the first side panel 18 by a hinged connection in the form of a fold line 31A. A fourth corner panel 28B is hingedly connected to a second end of the second side panel 20 by a hinged connection in the form of a fold line 31B.

A third securing panel 26A is hingedly connected to the third corner panel 28A by a hinged connection in the form of a fold line 29A. The first securing panel 22A is separated from the second end panel 16 by a cut line or severable line 27A.

A fourth securing panel 26B is hingedly connected to the fourth corner panel 28B by a hinged connection in the form of a fold line 29B. The first securing panel 22A is separated from the second end panel 16 by a cut line or severable line 27B.

The main panel 12 comprises at least one article retention structure RT1, RT2. The main panel 12 comprises a plurality of article retention structures RT1, RT2, specifically six article retention structures RT1, RT2 arranged in 2×3 matrix or array. Each of the article retention structures RT1, RT2 comprises an opening or aperture A1, A2.

The article retention structures RT1, RT2 of the illustrated embodiment take the form of a plurality of teeth or tabs 40, 42, 44, 46, 70, 72, 74, 76—specifically, but not limited to, four teeth or tabs 40, 42, 44, 46, 70, 72, 74, 76—arranged in about an aperture A1, A2 to form part of an article receiving opening.

The blank 10 comprises four first or endmost article retention structures RT1 each comprising a first opening or aperture A1. The blank 10 comprises two second, medial or intermediate article retention structures RT2 each comprising a second opening or aperture A2.

The endmost article retention structures RT1 comprises an article receiving opening defined in part by the first aperture A1 which is defined in, or struck from, the main panel 12.

The intermediate article retention structures RT2 comprises an article receiving opening defined in part by the second aperture A2 which is defined in, or struck from, the main panel 12.

The endmost article retention structures RT1 comprise a first plurality of teeth or tabs 40, 42, 44, 46 disposed about the first aperture A1 and the intermediate article retention structures RT2 each comprise a second plurality of teeth or tabs 70, 72, 74, 76 disposed about the second aperture A2.

The first plurality of teeth 40, 42, 44, 46 are provided by the main panel 12. Each of the teeth 40, 42, 44, 46 is hingedly connected to the main panel 12, by a respective hinged connection 41, 43, 45, 47. Each hinged connection may be defined by a plurality of cut lines. Each hinged connection may be arranged to be linear.

Each of the first plurality of teeth 40, 42, 44, 46 is separated from its adjacent neighbours by a cut line 49, 51, 53, 55. The cut line 49, 51, 53, 55 may extend radially outward from the first aperture A1. In the illustrated embodiment, a first cutline 49 is disposed opposite a third cut line 53 (the first and third cut lines 49, 53 being collinear), a second cut line 51 is disposed opposite a fourth cut line 55 (the second and fourth cut lines 51, 55 being collinear).

At least one of the cut lines 49, 51, 53, 55 may terminate at a cut 57, 59, the cut 57, 59 may be linear and may be oriented perpendicularly with respect to the at least one of the cut lines 49, 51, 53, 55. In the illustrated embodiment, a pair of the cut lines 49, 51, 53, 55 may terminate at a transverse cut 57, 59. The second cutline 51 and the fourth cut line 55 each may terminate at a respective cut 57, 59. A notional line collinear with the second cutline 51 and the fourth cut line 55 passes through a corner of the main panel 12, the corner may be defined by the vertex or intersection of a pair of adjacent fold lines 13, 15, 17, 19.

The cut 57 terminating the second cutline 51 may extend between an adjacent pair of hinged edges of the main panel 12, between a pair of adjacent fold lines 13, 15, 17, 19.

The cuts 57, 59 may extend between a pair of adjacently disposed hinged connections 41, 43, 45, 47 of the first plurality of teeth 40, 42, 44, 46.

A first tooth 40 may be hinged to the main panel 12 by a first hinged connection 41, the first hinged connection 41 may be collinear or coincident with the fold line 13, 15 between the main panel 12 and the first or second end panel 14, 16.

A fourth tooth 46 may be hinged to the main panel 12 by a fourth hinged connection 47, the fourth hinged connection 47 may be collinear or coincident with the fold line 17, 19 between the main panel 12 and the first or second side panel 18, 20.

Optionally, one or more of the cutlines 49, 51, 53, 55 may be spaced apart from the first aperture A1 such that a connecting nick or bridge is provided between an adjacent pair of the first plurality of teeth 40, 42, 44, 46.

The second plurality of teeth 70, 72, 74, 76 is provided by the main panel 12. Each of the teeth 70, 72, 74, 76 is hingedly connected to the main panel 12, by a respective hinged connection 71, 73, 75, 77. Each hinged connection may be defined by a plurality of cut lines. Each hinged connection may be arranged to be linear.

Each of the second plurality of teeth 70, 72, 74, 76 is separated from its adjacent neighbours by a cut line 79, 81, 83, 85. The cut line 79, 81, 83, 85 may extend radially outward from the second aperture A2. In the illustrated embodiment, a first cutline 79 is disposed opposite a third cut line 83 (the first and third cut lines 79, 83 being collinear), a second cut line 81 is disposed opposite a fourth cut line 85 (the second and fourth cut lines 81, 85 being collinear).

At least one of the cut lines 79, 81, 83, 85 may terminate at a cut 87, 89, the cut 87, 89 may be linear and may be oriented perpendicularly with respect to the at least one of the cut lines 79, 81, 83, 85. In the illustrated embodiment, a pair of the cut lines 79, 81, 83, 85 may terminate at a transverse cut 87, 89. The first cutline 49 and the fourth cut line 85 each may terminate at a respective cut 87, 89.

The cuts 87, 89 may extend between a pair of adjacently disposed hinged connections 71, 73, 75, 77 of the second plurality of teeth 70, 72, 74, 76.

A fourth tooth 76 may be hinged to the main panel 12 by a fourth hinged connection 77, the fourth hinged connection 77 may be collinear or coincident with the fold line 17, 19 between the main panel 12 and the first or second side panel 18, 20.

Optionally, one or more of the cutlines 79, 81, 83, 85 may be spaced apart from the second aperture A2 such that a connecting nick or bridge is provided between an adjacent pair of the second plurality of teeth 70, 72, 74, 76.

The blank 10 may comprise a handle structure H, the handle structure H may comprise at least one finger opening. The illustrated embodiment comprises a pair of finger openings. Each finger opening may be defined, at least in part, by a handle tab 60 struck from, or defined in, the main panel 12. Each handle tab 60 is hingedly connected to the main panel 12 by a hinged connection in the form of a fold line 61, the handle tabs 60 may be hinged in opposition to each other.

The blank 10 can be applied to a group of articles B in a flat form and folded thereabout or may be preassembled and applied in the assembled condition to the group of articles B.

The main panel 12 may be lowered with respect to a group of articles B.

Each of the article retention structures RT1, RT2 of the blank 10 is aligned with a respective article B in the group. Portions of the articles B pass through the main panel 12. The toothed regions of the main panel 12 about each of the article retention structures RT1, RT2 may be folded out of the plane of the main panel 12.

Each toothed region of the main panel 12 may be folded about one of the articles B received in the respective one of the article retention structures RT1, RT2.

Engaging edges of the teeth 40, 42, 44, 46, 70, 72, 74, 76 engage beneath a projection. The projection may be located about the neck the article B of an article B. When the article B is a bottle, the projection may be provided by an end closure or cap. In this way, the engaging edges grip or hold the article B and prevent or inhibit the article B from unintentionally separating from the main panel 12.

The first and second side panels 18, 20 are folded about the opposing sides of the group of articles B. The corner panels 24A, 24B, 28A, 28B are folded about the corners of the group of articles B and the securing panels 22A, 22B, 26A, 26B are folded about ends of the group of articles B.

Glue or other adhesive treatment may be applied to the securing panels 22A, 22B, 26A, 26B or to an inner surface of corresponding regions of the first and second end panels 14, 16.

The first and second end panels 14, 16 are folded downwards about a respective end of the group of articles B. The first and second end panels 14, 16 are brought into face contacting relationship with respective ones of the securing panels 22A, 22B, 26A, 26B. The first and second end panels 14, 16 are secured to respective ones of the securing panels 22A, 22B, 26A, 26B.

A package comprising the article carrier 90 and the group of articles B is shown in FIG. 2.

The article carrier 90 may be preassembled before application to a group of articles B. The preassembled article carrier 90 may provide a skirt structure formed from the side panels 18, 20, the end panels 14, 16, and the corner panels 24A, 24B, 28A, 28B. In the preassembled article carrier 90, each pair of opposing panels of the skirt structure (i.e., the opposing side panels 18, 20, the opposing end panels 14, 16, the opposing corner panels 22A, 28B and the opposing corner panels 22B, 28A) are inclined with respect to the main panel 12 such that the respective pair of opposing panels diverge away from each other as they extend downwards from the main panel 12. The skirt structure may closely fit the shoulders of the articles B and may compress or encourage a tight grouping of the articles B. The inclined nature of the skirt structure and the shoulders of the articles B may have a tendency to force the article carrier 90 upwardly with respect to the articles B. The article retention structures RT1, RT2 provide tabs 40, 42, 44, 46, 70, 72, 74, 76 which engage a projection or undercut in of the articles B. This engagement resists or opposes the upward movement of the article carrier 90 generated by the skirt structure. In this way, the articles B are held in a tightly formed group by the article carrier 90 and the tabs 40, 42, 44, 46, 70, 72, 74, 76 are in secure engagement with articles B. The carrier 90 in the assembled form may comprise at least one dimension which is smaller than the equivalent dimension of the group of articles B it is applied to. In this way, when the carrier 90 is applied to the articles B a tight fit can be achieved, in doing so the shape of the carrier or at least a part of it may change to accommodate the articles B.

Figure 3:
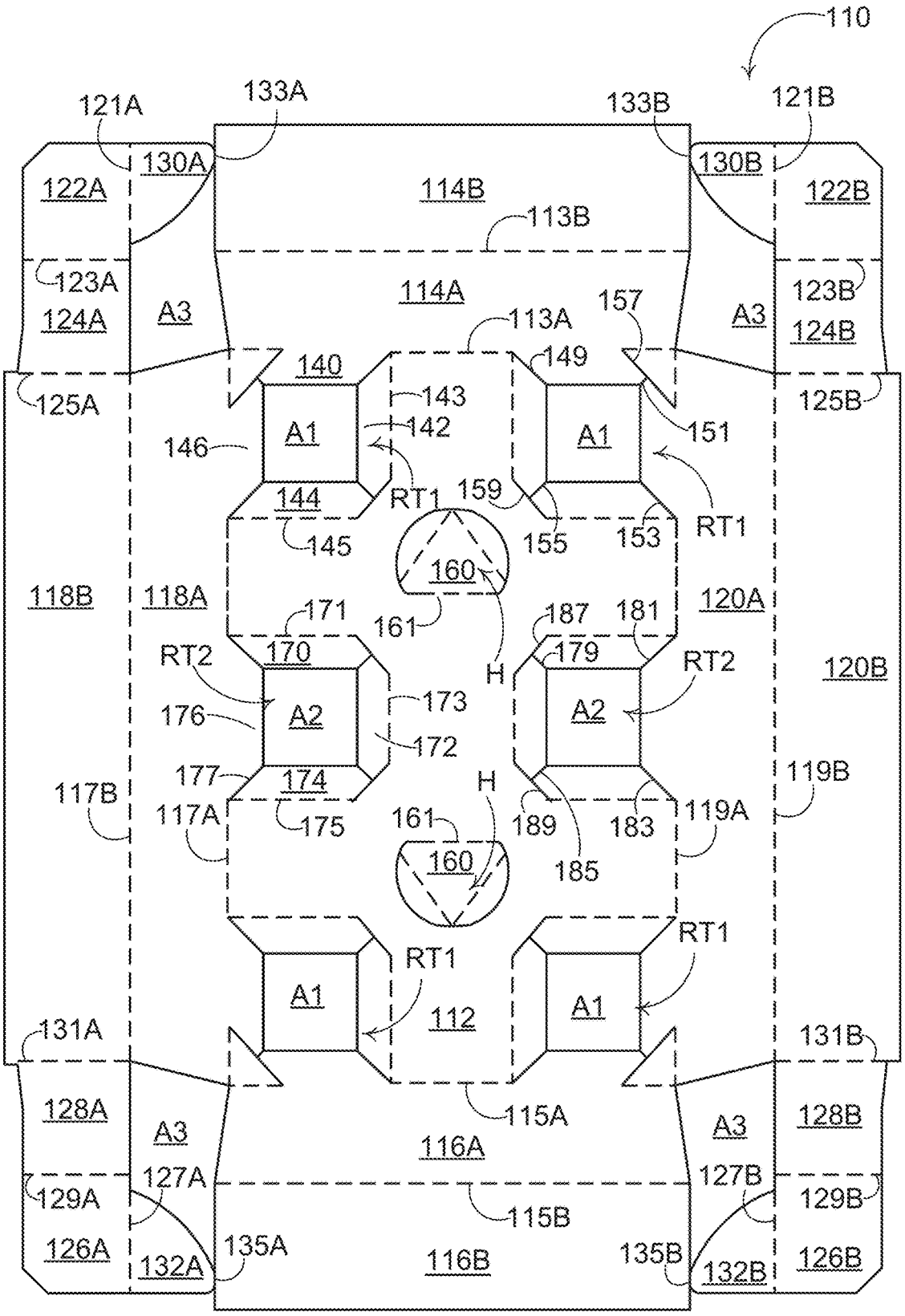
FIG. 3 is a plan view from above of a blank for forming a carrier according to a second embodiment.
Figure 4:
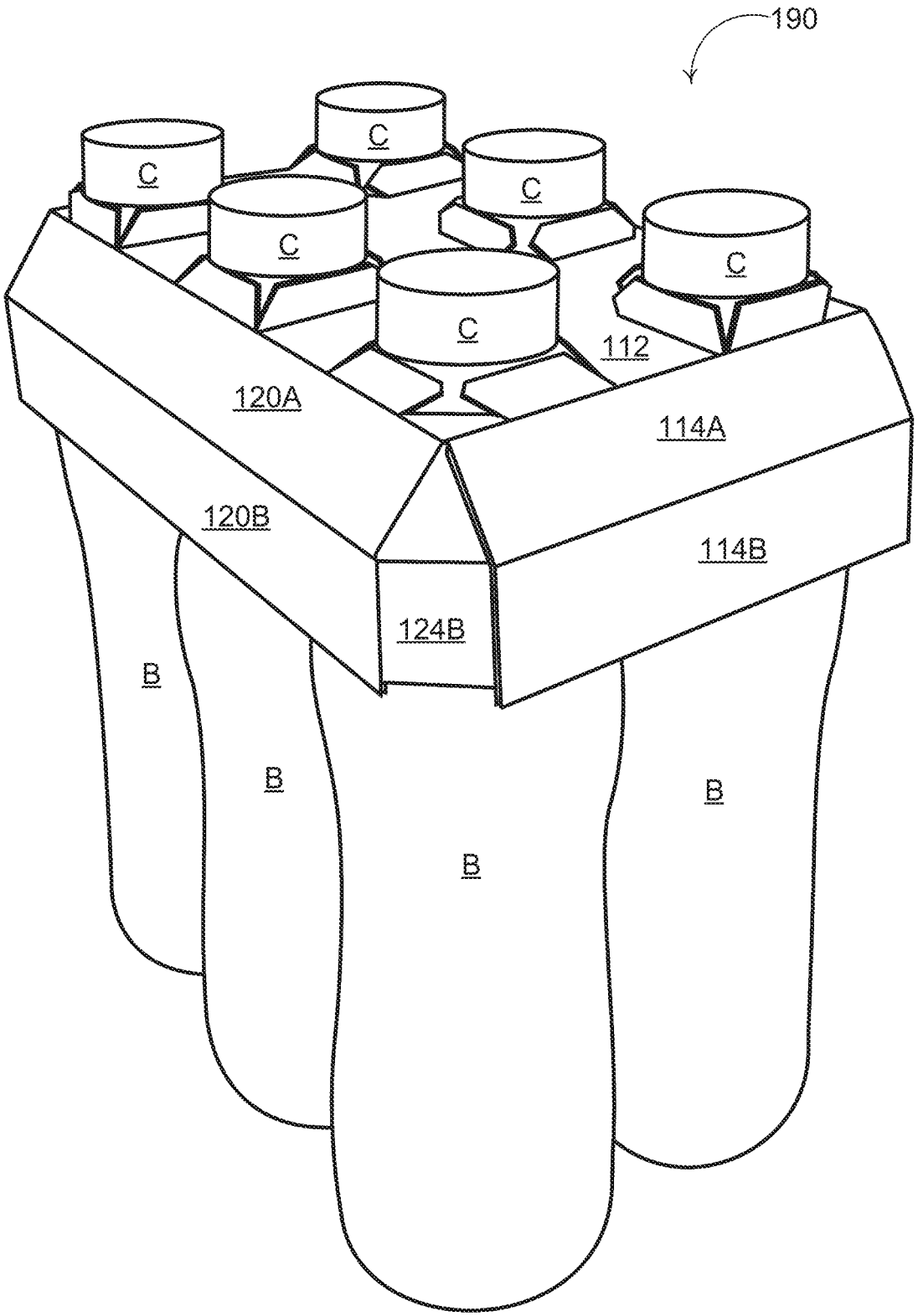
FIG. 4 is a perspective view from above of a carrier formed from the blank of FIG. 3.
Figure 5:
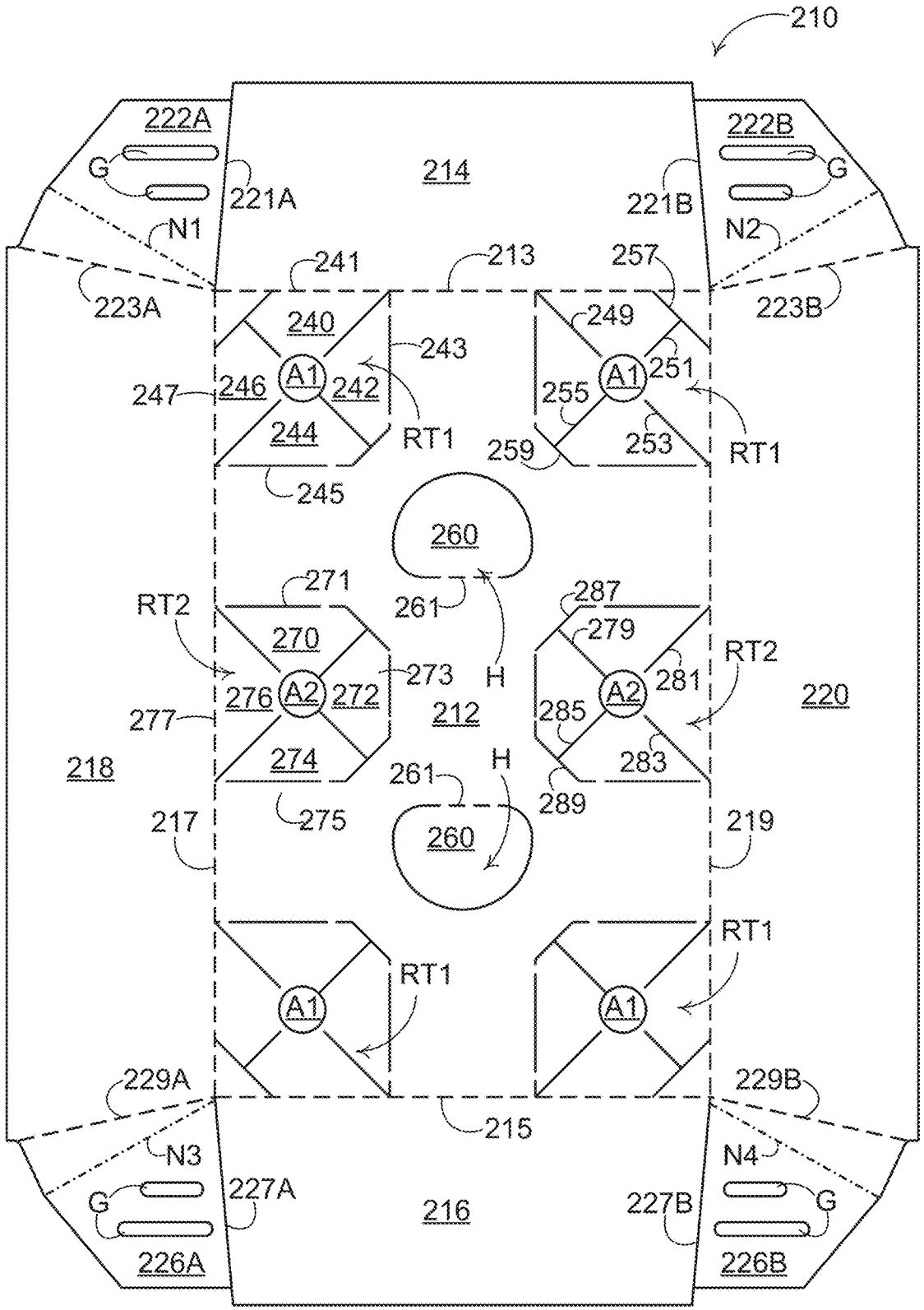
FIG. 5 is a plan view from above of a blank for forming a carrier according to a third embodiment.

Referring now to FIGS. 3 to 5 there is shown an alternative embodiment of the present disclosure. In the second illustrated embodiment, like numerals have, where possible, been used to denote like parts, albeit with the addition of the prefix "100" to indicate that these features belong to the second embodiment. The alternative embodiment shares many common features with the embodiment of FIGS. 1 and 2, therefore only the differences from the embodiment illustrated in FIGS. 1 and 2 will be described in any greater detail.

FIG. 3 shows a blank 110 comprising a plurality of panels 112, 114A, 114B, 116A, 116B, 118A, 118B, 120A, 120B, including a main panel 112 for forming a top wall or engaging panel of a carrier 190 (see FIG. 4).

A first upper end panel 114A is hingedly connected to a first end of the main panel 112 by a hinged connection in the form of a fold line 113A. A first lower end panel 114B is hingedly connected to the first upper end panel 114A by a hinged connection in the form of a fold line 113B.

A second upper end panel 116A is hingedly connected to a second end of the main panel 112 by a hinged connection in the form of a fold line 115A. A second lower end panel 116B is hingedly connected to the second upper end panel 116A by a hinged connection in the form of a fold line 115B.

A first upper side panel 118A is hingedly connected to a first side of the main panel 112 by a hinged connection in the form of a fold line 117A. A first lower side panel 118B is hingedly connected to the first upper side panel 118A by a hinged connection in the form of a fold line 117B.

A second upper side panel 120A is hingedly connected to a second side of the main panel 112 by a hinged connection in the form of a fold line 119A. A second lower side panel 120B is hingedly connected to the second upper side panel 120A by a hinged connection in the form of a fold line 119B.

A first corner panel 124A is hingedly connected to a first end of the first lower side panel 118A by a hinged connection in the form of a fold line 125A. A second corner panel 124B is hingedly connected to a first end of the second lower side panel 120B by a hinged connection in the form of a fold line 125B.

A first securing panel 122A/130A is hingedly connected to the first corner panel 124A by a hinged connection in the form of a fold line 123A. The first securing panel 122A/130A comprises a first lower securing panel portion 122A and a first upper securing panel portion 130A, the first lower securing panel portion 122A is hingedly connected to a first upper securing panel portion 130A by a hinged connection in the form of a fold line 121A. The first upper securing panel portion 130A is separated from the first upper and lower end panels 114A, 114B by a cut line 133A or by a frangible or severable line. An aperture A3 separates the first corner panel 124A from the first upper end panel 114A; the aperture A3 also separates first upper securing panel portion 130A from the first upper side panel 118A and a portion of the first lower end panel 114B.

A second securing panel 122B/130B is hingedly connected to the second corner panel 124B by a hinged connection in the form of a fold line 123B. The second securing panel 122B/130B comprises a second lower securing panel portion 122B and a second upper securing panel portion 130B, the second lower securing panel portion 122B is hingedly connected to a second upper securing panel portion 130B by a hinged connection in the form of a fold line 121B. The second upper securing panel portion 130B is separated from the first upper and lower end panels 114A, 114B by a cut line 133B or by a frangible or severable line. An aperture A3 separates the second corner panel 124B from the first upper end panel 114A; the aperture A3 also separates second upper securing panel portion 130B from the second upper side panel 120A and a portion of the first lower end panel 114B.

A third corner panel 128A is hingedly connected to a second end of the first lower side panel 118A by a hinged connection in the form of a fold line 131A. A fourth corner panel 128B is hingedly connected to a second end of the second lower side panel 120A by a hinged connection in the form of a fold line 131B.

A third securing panel 126A/132A is hingedly connected to the third corner panel 128A by a hinged connection in the form of a fold line 129A. The third securing panel 126A/132A comprises a third lower securing panel portion 126A and a third upper securing panel portion 132A, the third lower securing panel portion 126A is hingedly connected to a third upper securing panel portion 132A by a hinged connection in the form of a fold line 127A. The third upper securing panel portion 132A is separated from the second upper and lower end panels 116A, 116B by a cut line 135A or by a frangible or severable line. An aperture A3 separates the third corner panel 128A from the second upper end panel 116A; the aperture A3 also separates third upper securing panel portion 132A from the first upper side panel 118A and a portion of the second lower end panel 116B.

A fourth securing panel 126B/132B is hingedly connected to the fourth corner panel 128B by a hinged connection in the form of a fold line 129B. The fourth securing panel 126B/132B comprises a fourth lower securing panel portion 126B and a fourth upper securing panel portion 132B, the fourth lower securing panel portion 126B is hingedly connected to a fourth upper securing panel portion 132B by a hinged connection in the form of a fold line 127B. The fourth upper securing panel portion 132B is separated from the second upper and lower end panels 116A, 116B by a cut line 135B or by a frangible or severable line. An aperture A3 separates the fourth corner panel 128B from the second upper end panel 116A; the aperture A3 also separates fourth upper securing panel portion 132B from the second upper side panel 120A and a portion of the second lower end panel 116B.

The main panel 112 comprises at least one article retention structure RT1, RT2. The main panel 112 comprises a plurality of article retention structures RT1, RT2, specifically six article retention structures RT1, RT2 arranged in 2×3 matrix or array. Each of the article retention structures RT1, RT2 is substantially the same in construction as the article retention structures RT1, RT2 of FIG. 1 and will not be described in further detail, albeit the apertures A1, A2 are square in shape.

FIG. 4 illustrates an article carrier 190 formed from the blank 110. The upper end and side panels 114A, 116A, 118A, 120A are disposed about the shoulder of the articles B, the lower end and side panels 114B, 116B, 118B, 120B are disposed about the shoulder and/or main body of the articles B.

The end and side panels 114B, 116B, 118B, 120B are connected by the corner panels 124A, 124B, 128A, 128B. The upper end panels 114A, 116A are free of connection to the upper side panels 118A, 120A. The article carrier 190 may be preassembled before application to a group of articles B. The preassembled article carrier 190 may provide a skirt structure formed from the side panels 118A/118B, 120A/120B, the end panels 114A/114B, 116A/116B and the corner panels 124A, 124B, 128A, 128B. In the preassembled carrier 190, each pair of opposing upper panels of the skirt structure (i.e., the opposing upper side panels 118A, 120A and the opposing upper end panels 114A, 116A) are inclined with respect to the main panel 112 such that the respective pair of opposing panels diverge away from each other as they extend downwards from the main panel 112. The opposing lower side panels 118B, 120B extend from the lower edges of the upper side panels 118A, 120A, respectively. The lower side panels 118B, 120B are substantially planar and perpendicular to the main panel 112. The opposing lower end panels 114B, 116B extend from the lower edges of the upper end panels 114A, 116A, respectively. The lower end panels 114B, 116B are substantially planar and perpendicular to the main panel 112. Each corner panel 124A, 124B, 128A, 128B interconnects the adjacent lower side and end panels to provide the respective corner panel of the skirt structure. The corner panels 124A, 124B, 128A, 128B are substantially planar and perpendicular to the main panel 112. The skirt structure may closely fit the shoulders of the articles B and may compress or encourage a tight grouping of the articles B. The inclined nature of the upper end and side panels 114A, 116A, 118A, 120A of the skirt structure and the shoulders of the articles B may have a tendency to force the article carrier 190 upwardly of the articles B.

Referring now to FIGS. 5 to 12B there is shown further alternative embodiments of the present disclosure. In the third, fourth, and fifth illustrated embodiments, like numerals have, where possible, been used to denote like parts, albeit with the addition of the prefix "200"; "300"; "400" to indicate that these features belong to the third, fourth, and fifth embodiment respectively. The further alternative embodiments share many common features with the embodiments of FIGS. 1 to 4, therefore only the differences from the embodiment illustrated in FIGS. 1 to 4 will be described in any greater detail.

Figure 6:
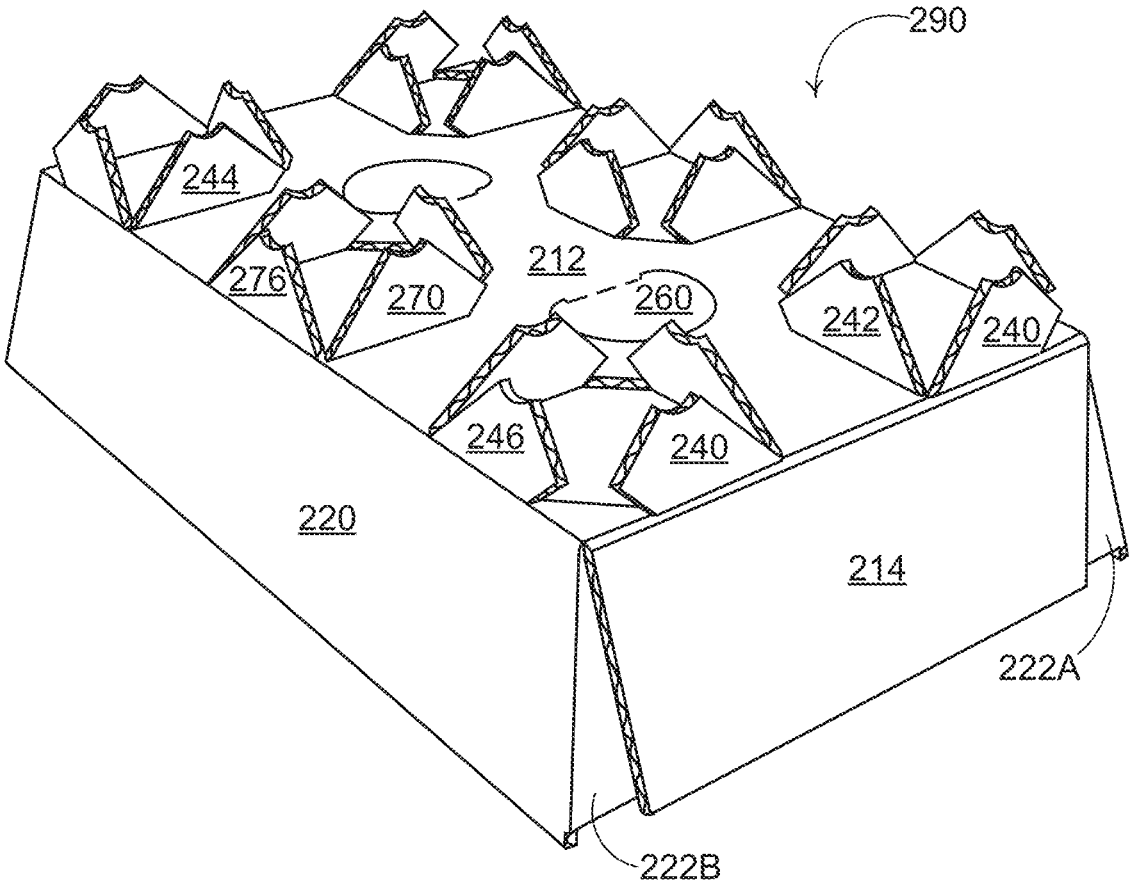
FIG. 6 is a perspective view from above of a carrier formed from the blank of FIG. 5.

FIG. 5 shows a blank 210, according to a third embodiment, comprising a plurality of panels 212, 214, 216, 218, 220, including a main panel 212 for forming a top wall or engaging panel of a carrier 290 (see FIG. 6).

The blank 210 of FIG. 5 is substantially similar in construction to the blank of FIG. 1, albeit the corner panels 24A, 24B, 28A, 28B have been omitted. A first securing panel 222A is hingedly connected to a first end of the first side panel 218 by a hinged connection in the form of a fold line 223A. The first securing panel 222A is separated from the first end panel 214 by a cut line or severable line 221A. The fold line 223A is obliquely oriented with respect to the fold line 217 hinging the first side panel 218 to the top panel 212.

A second securing panel 222B is hingedly connected to a first end of the second side panel 220 by a hinged connection in the form of a fold line 223B. The second securing panel 222B is separated from the first end panel 214 by a cut line or severable line 221B. The fold line 223B is obliquely oriented with respect to the fold line 219 hinging the second side panel 220 to the top panel 212.

A third securing panel 226A is hingedly connected to a second end of the first side panel 218 by a hinged connection in the form of a fold line 229A. The third securing panel 222A is separated from the second end panel 216 by a cut line or severable line 227A. The fold line 229A is obliquely oriented with respect to the fold line 217 hinging the first side panel 218 to the top panel 212.

A fourth securing panel 226B is hingedly connected to a second end of the second side panel 220 by a hinged connection in the form of a fold line 229B. The fourth securing panel 222A is separated from the second end panel 216 by a cut line or severable line 227B. The fold line 229B is obliquely oriented with respect to the fold line 219 hinging the second side panel 220 to the top panel 212.

The first and second side panels 218, 220 are tapered in shape such that they are wider at a lower edge than at an upper, hinged, edge. In the embodiment of FIG. 1 the first and second side panels 218, 220 substantially rectangular in shape. The first and second end panels 214, 216 are tapered in shape such that they are narrower at a lower edge than at an upper, hinged, edge in a similar manner to the first and second end panels 14, 16 of FIG. 1.

In an assembled form, the blank 210 forms a carrier 290 having square corners, whereas the blank 10 of FIG. 1 formed a carrier 90 having bevelled or chamfered corners.

FIG. 5 shows notional lines N1, N2, N3, N4 which define regions of the securing panels 222A, 222B, 226A, 226B which overlap with a respective one of the first and second side panels 218, 220 in a setup condition. The overlapping regions provides at least one glue region G for adhesively securing the securing panels 222A, 222B, 226A, 226B to the first and second side panels 218, 220 to create a skirt structure.

The article carrier 290 may be preassembled before application to a group of articles. The article carrier 290 may provide a skirt structure in the form of side panels 218, 220 and end panels 214, 216. The skirt structure may closely fit the shoulders of the articles B and may compress or encourage a tight grouping of the articles B. The inclined nature of the skirt structure and the shoulders of the articles B may have a tendency to force the article carrier 290 upwardly with respect to the packaged articles B. The article retention structures RT1, RT2 provide tabs 240, 242, 244, 246, 270, 272, 274, 276 which engage a projection or undercut in of the articles B. This engagement resists or opposes the upward movement of the article carrier 290 generated by the skirt structure. In this way, the articles B are held in a tightly formed group by the article carrier 290 and the tabs 240, 242, 244, 246, 270, 272, 274, 276 are in secure engagement with articles B. The carrier 290 in the assembled form may comprise at least one dimension which is smaller than the equivalent dimension of the group of articles B it is applied to. In this way, when applied to the articles B, a tight fit can be achieved, in doing so, the shape of the carrier or at least a part of it may change to accommodate the articles B.

Figure 7:
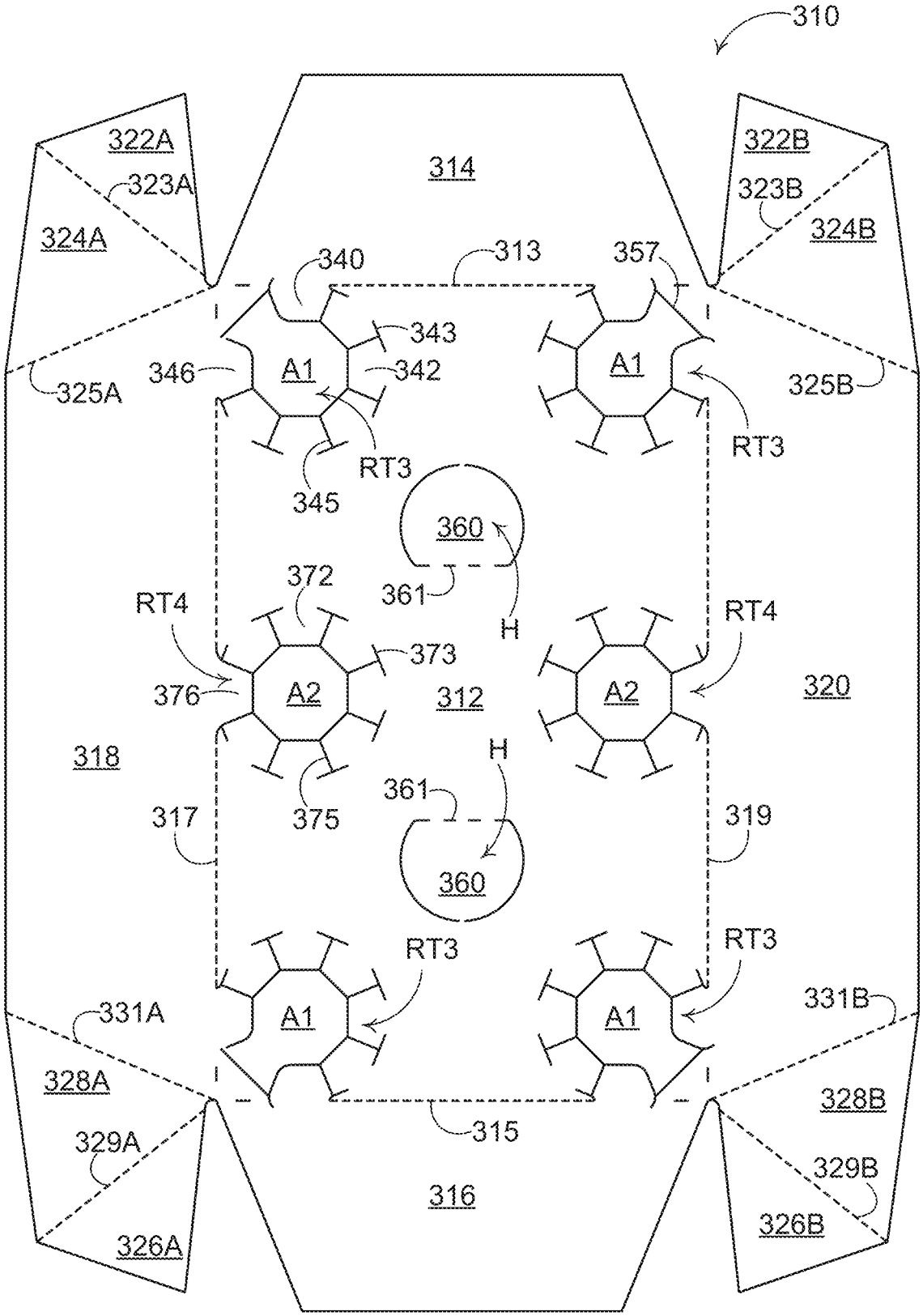
FIG. 7 is a plan view from above of a blank for forming a carrier according to a fourth embodiment.
Figure 8:
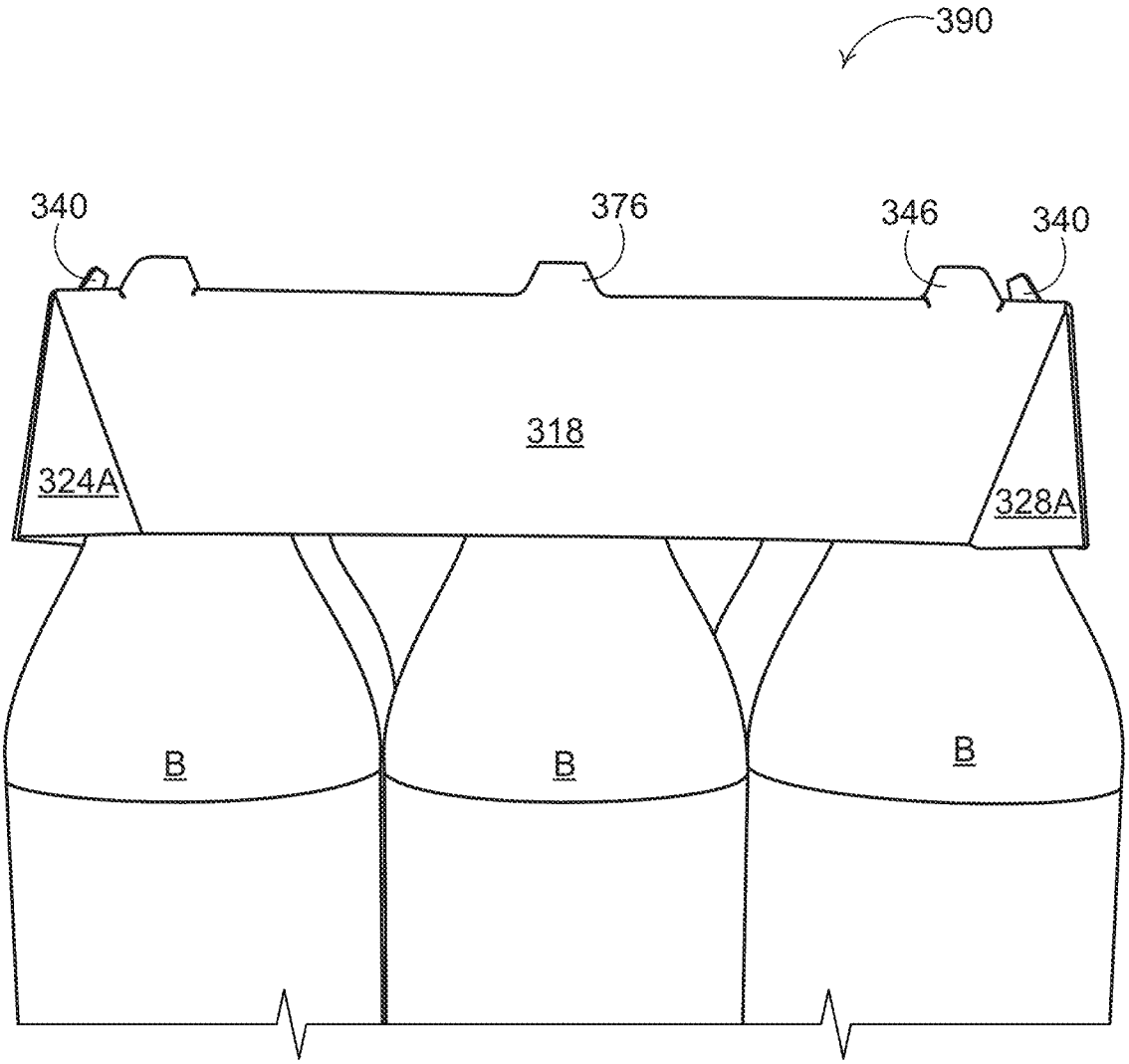
FIGS. 8 to 10 illustrate stages of application of a carrier formed from the blank of FIG. 7 to a group of articles.

FIG. 7 shows a blank 310, according to a fourth embodiment, comprising a plurality of panels 312, 314, 316, 318, 320, including a main panel 312 for forming a top wall or engaging panel of a carrier 390 (see FIG. 8).

The blank 310 of FIG. 7 is similar in construction to the blank of FIGS. 1, the blank 310 comprises corner panels 324A, 324B, 328A, 328B which have been increased in dimension compared to the corner panels 24A, 24B, 28A, 28B of the blank 10 of FIG. 1. The blank 310 comprises a first securing panel 322A hingedly connected to a first corner panel 324A by a hinged connection in the form of a fold line 323A. The first securing panel 322A is separated from the first end panel 314 by a cutaway in the form of a recess, the recess may be "V" shaped. The fold line 323A is obliquely oriented with respect to the fold line 317 hinging the first side panel 318 to the top panel 312.

A second securing panel 322B is hingedly connected to a second corner panel 324B by a hinged connection in the form of a fold line 323B. The second securing panel 322B is separated from the first end panel 314 by a cutaway in the form of a recess, the recess may be "V" shaped. The fold line 323B is obliquely oriented with respect to the fold line 319 hinging the second side panel 320 to the top panel 312.

A third securing panel 326A is hingedly connected to a third corner panel 328A by a hinged connection in the form of a fold line 329A. The third securing panel 322A is separated from the second end panel 316 by a cutaway in the form of a recess, the recess may be "V" shaped. The fold line 329A is obliquely oriented with respect to the fold line 317 hinging the first side panel 318 to the top panel 312.

A fourth securing panel 326B is hingedly connected to a fourth corner panel 328B by a hinged connection in the form of a fold line 329B. The fourth securing panel 322A is separated from the second end panel 316 by a cutaway in the form of a recess, the recess may be "V" shaped. The fold line 329B is obliquely oriented with respect to the fold line 319 hinging the second side panel 320 to the top panel 312.

The first and second side panels 318, 320 are tapered in shape such that they are narrower at a lower edge than at an upper, hinged, edge. The first and second end panels 314, 316 are tapered in shape such that they are narrower at a lower edge than at an upper, hinged, edge. The degree of tapering has been increased such that free end edges of the first and second end panels 314, 316 and the hinged connection 313, 315 to the top panel 312 define a smaller, more acute, angle therebetween when compared to the blanks 10, 210 of FIGS. 1 and 5.

The blank 310 comprises alternative article retention structures RT3, RT4. The main panel 312 comprises a plurality of article retention structures RT3, RT4, specifically six article retention structures RT3, RT4 arranged in 2×3 matrix or array. Each of the article retention structures RT3, RT4 comprises an opening or aperture A1, A2.

The article retention structures RT3, RT4 of the illustrated embodiment take the form of a plurality of teeth or tabs 340, 342, 346, 372, 376 arranged about an aperture A1, A2, —specifically, but not limited to, seven teeth or tabs 340, 342, 346 arranged about a first aperture A1 of first or endmost article retention structures RT3 and eight teeth or tabs 372, 376 arranged about a second aperture A1 of second or intermediate article retention structures RT4—to form part of an article receiving opening.

The blank 310 comprises four first corner or endmost article retention structures RT3 each comprising a first opening or aperture A1. The blank 310 comprises two second, medial or intermediate article retention structures RT4 each comprising a second opening or aperture A2. Aperture A2 may be octagonal in shape, in other embodiments it may be circular.

The intermediate article retention structures RT4 comprise eight teeth 370, 372 disposed about the second aperture A2. The teeth 370, 372 are defined in part by first cutlines 375 extending radially outward from the second aperture A2, from corners thereof. The teeth 370, 372 include a first tooth 376 extending from one of the first or second side panels 318, 320 and integral therewith. The teeth 370, 372 include seven second teeth 370 hingedly connected to the main panel 312. A second, circumferential, cutline 373 may be provided at the end of each first cutline 375 separating a pair of second teeth 370. A hinged connection, between the second teeth 370 and the main panel 312, is defined between a pair of second cutlines 373.

The endmost article retention structures RT3 are similar in construction to the intermediate article retention structures RT4 albeit they comprise two first teeth 340, 346 each extending from and integral with one of an end and side panel 314, 316, 318, 320. The endmost article retention structures RT3 comprises five second teeth 342, the second teeth 340 being separated by first, radial, cutlines 345. The first cutlines 345 bisect a second, circumferential, cutline 343.

The endmost article retention structures RT3 comprise a cutaway or recess interrupting the annular series of teeth 340, 342, 346. The cutaway may be equivalent to removal of a tooth adjacent to the corner of the main panel 312 at cut line 357 may extend between the pair of first teeth 340, 346 to define a corner portion of the main panel 312 coupling an end panel 314, 316 to a side panel 318, 320. The cutline 357 may extend between a pair of adjacently disposed fold lines 313/317, 313/319, 315/317, 315/319.

Figure 9:
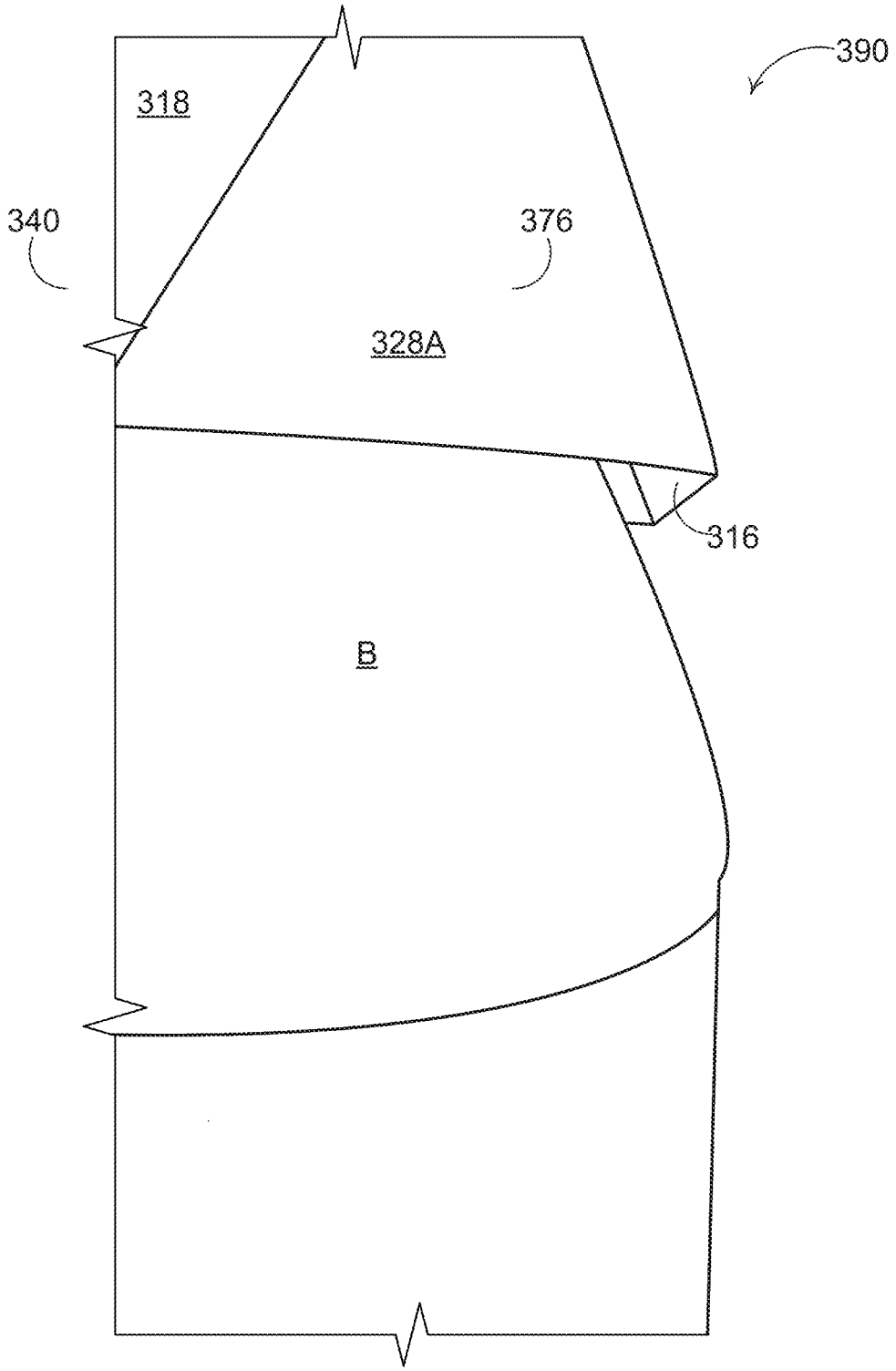
Figure 10:
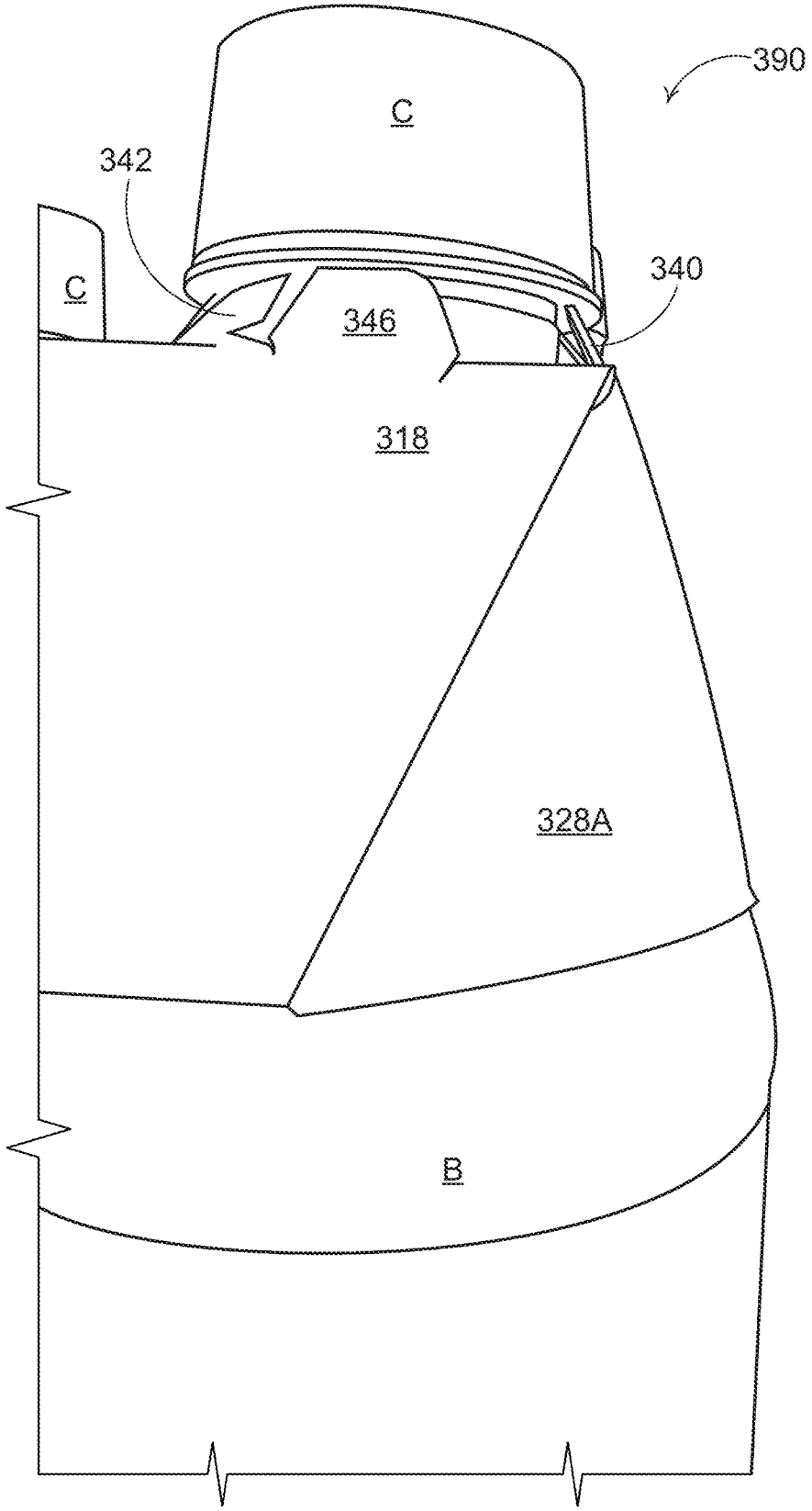

FIGS. 8 to 10 illustrate a carrier 390 in stages of application to a group of articles B. The carrier 390 is pre-formed, that is to say it is assembled prior to application to the articles B. The preassembled article carrier 390 may provide a skirt structure formed of the side panels 318, 320, the end panels 314, 316 and the corner panels 324A, 324B, 328A, 328B. In the preassembled carrier 390, each pair of opposing panels of the skirt structure (i.e., the opposing side panels 318, 320, the opposing upper end panels 314, 316, the diagonally opposing corner panels 324A, 328B and the diagonally opposing corner panels 324B, 328A) may be inclined with respect to the main panel 312 such that the respective pair of opposing panels diverge away from each other as they extend downwards from the main panel 312. FIG. 8 shows the carrier 390 placed over the upper end of a group of articles B. The first teeth 340, 346, 376 are displaced out of the plane of the main panel 312 and remain generally coplanar with the side or end panel 318, 320, 314, 316 from which they extend. The carrier 390 is structured such that the corner panels 324A, 324B, 328A, 328B are the first panels of a skirt structure 314/324A/318/328A/316/328B/320/324B to make contact with the sidewalls, neck or shoulders of articles B in the group, as shown in FIG. 9.

As the carrier 390 is moved downwardly with respect to the articles B, upper ends, end closures C, of the articles B are received in the openings of the article retention structures RT3, RT4. The corner panels 324A, 324B, 328A, 328B slide downwardly about the sidewalls, neck or shoulders of articles B at each corner of the group of articles B. The corner panels 324A, 324B, 328A, 328B are deformed from their initial planar shape and may adopt a generally convex shape (when viewed from an external viewpoint) as shown in FIG. 10; in doing so the length or area of a region of the corner panels 324A, 324B, 328A, 328B in contact with the article B may increase.

Figure 11:
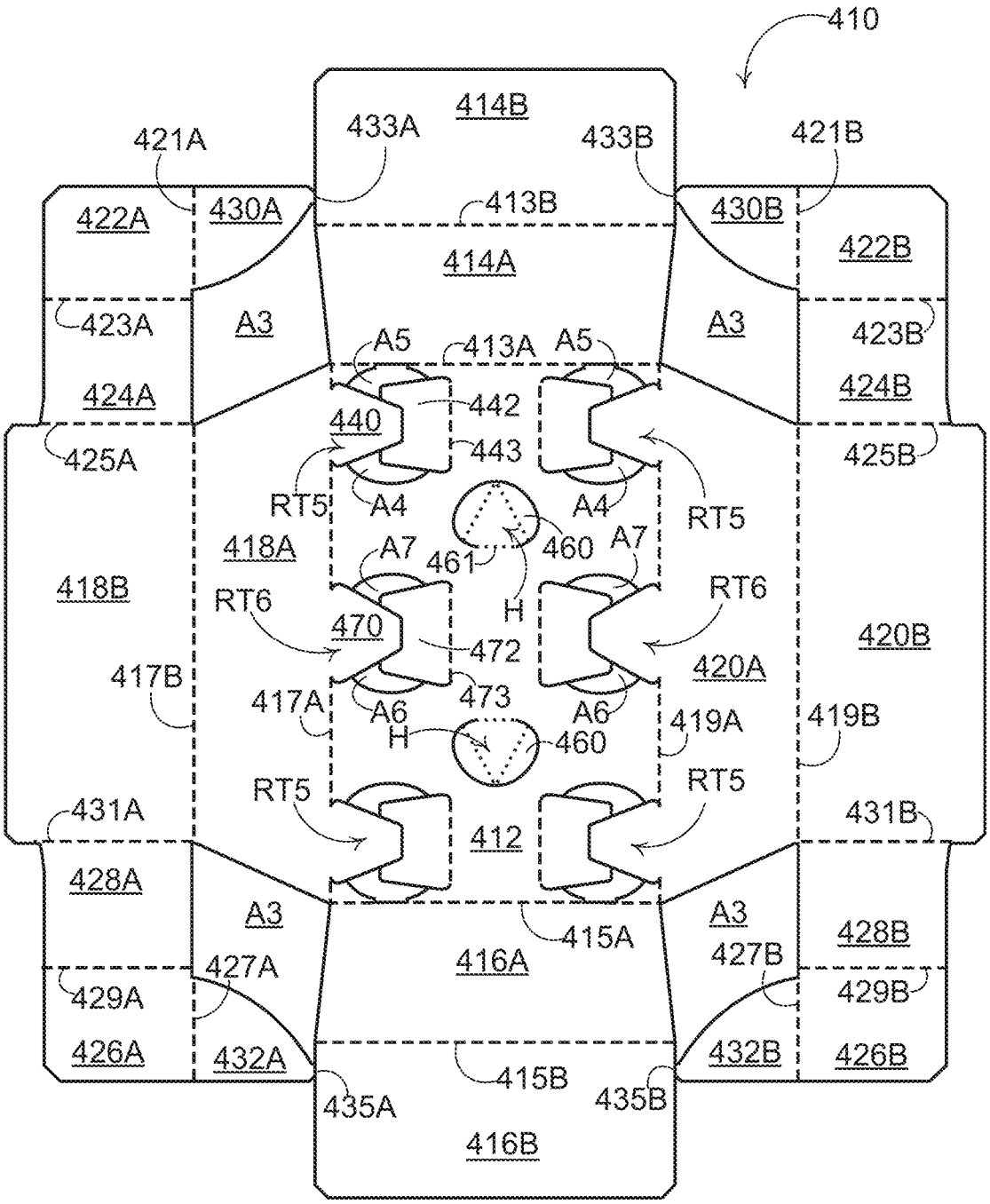
FIG. 11 is a plan view from above of a blank for forming a carrier according to a fifth embodiment.
Figure 12A:
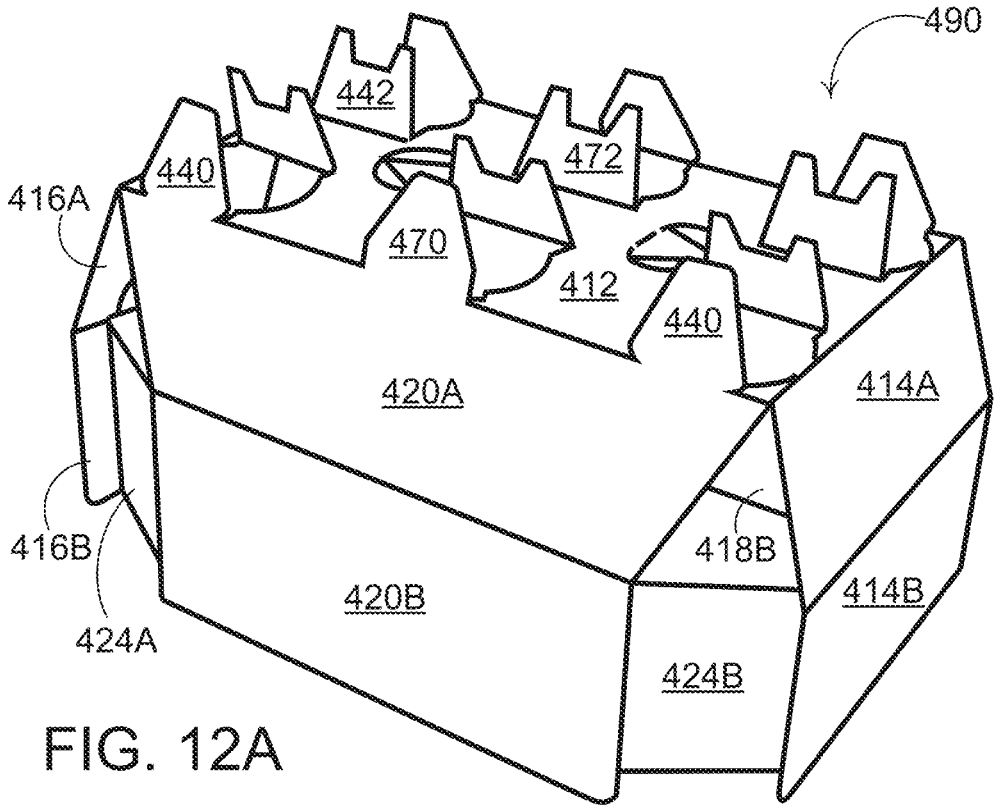
FIG. 12 is a perspective view from above of a carrier formed from the blank of FIG. 11.
Figure 12B:
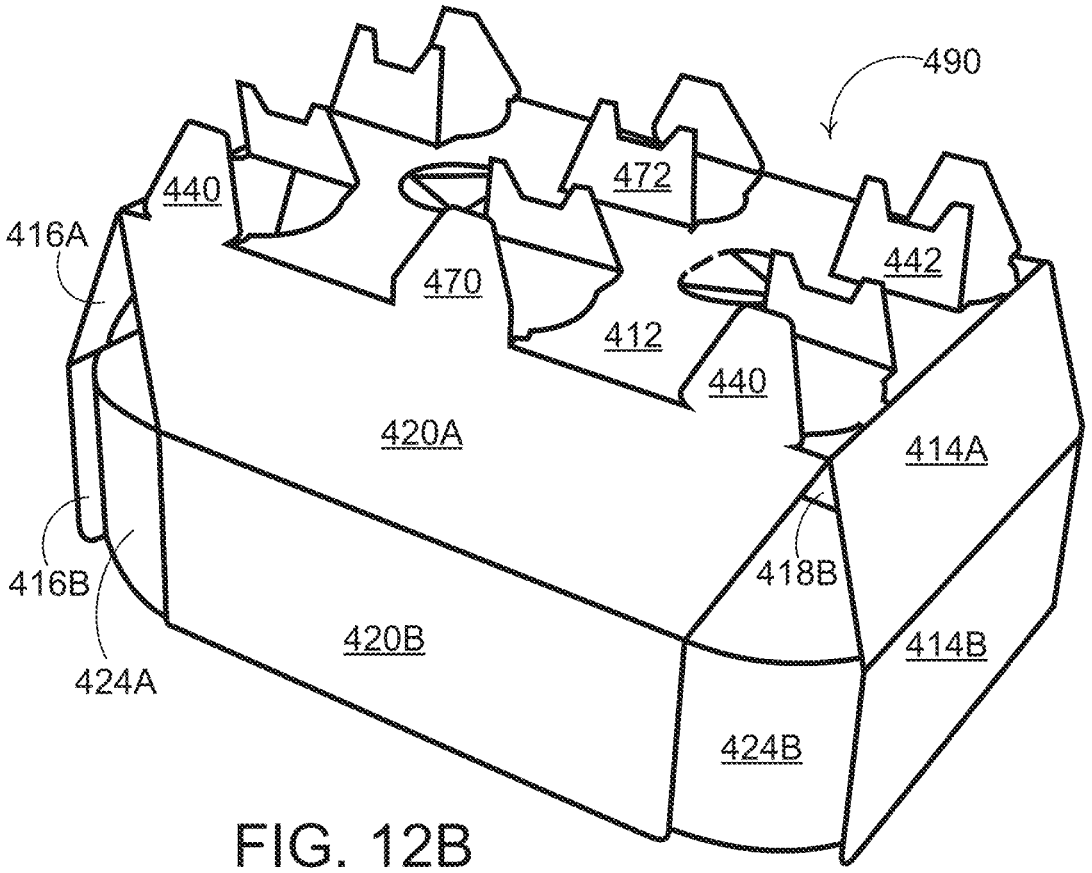

FIG. 11 shows a blank 410, according to a fifth embodiment, comprising a plurality of panels 412, 414A, 414B, 416A, 416B, 418A, 418B, 420A, 420B, including a main panel 412 for forming a top wall or engaging panel of a carrier 490 (see FIGS. 12A and 12B).

The blank 410 of FIG. 11 is similar in construction to the blank of FIG. 3, the blank 410 comprises alternative article retention structures RT5, RT6. The main panel 412 comprises a plurality of article retention structures RT5, RT6, specifically six article retention structures RT5, RT6 arranged in 2×3 matrix or array. Each of the article retention structures RT5, RT6 comprises an opening or aperture A1, A2.

The article retention structures RT5, RT6 comprise a pair of opposed tabs 440, 442, 470, 472. A first tab 440, 470 extends from one of the first or second side panels 418, 420 and is integral therewith. A second tab 442, 472 is hingedly connected to the main panel 412 by a hinged connection in the form of a fold line 443. A portion of the first tab 440, 470 is struck from the second tab 442, 472, that is to say it is formed from material which would otherwise form the second tab 442, 472. A pair of apertures A4, A5, A6, A7 define at least part of opposed side edges of the first and second tabs 440, 442, 470, 472. The endmost or corner retention structures RT5 may comprise an outer or endmost aperture A5 configured to interrupt the fold line 413A, 415A between a respective upper end panel 414A, 416A and the main panel 412. The endmost aperture A5 may comprises a cutaway or recces defining an edge portion of the endmost aperture A5 arranged to be collinear with said fold line 413A, 415A.

FIGS. 12A and 12B illustrate a carrier 490 formed from the blank 410 of FIG. 11. The blank 410 is preassembled into a carrier 490 as shown in FIG. 12A. In FIG. 12A, the corner panels 424A, 424B 428A, 428B are substantially planar and extend between a lower side panel 418A, 420A and a lower end panel 414A, 416A. More specifically, the preassembled article carrier 490 of FIG. 12A may provide a skirt structure formed of the side panels 418A/418B, 420A/420B, the end panels 414A/414B, 416A/416B and the corner panels 424A, 424B, 428A, 428B. Each pair of opposing upper panels (i.e., the opposing upper side panels 418A, 420A and the opposing upper end panels 414A, 416A) are inclined with respect to the main panel 412 such that the respective pair of opposing panels diverge away from each other as they extend downwards from the main panel 412. The opposing lower side panels 418B, 420B extend from the lower edges of the upper side panels 418A, 420A, respectively. The lower side panels 418B, 420B are substantially planar and perpendicular to the main panel 412. The opposing lower end panels 414B, 416B extend from the lower edges of the upper end panels 414A, 416A, respectively. The lower end panels 414B, 416B are substantially planar and perpendicular to the main panel 412. Each corner panel 424A, 424B, 428A, 428B interconnects the adjacent lower side and end panels to provide the respective corner panel of the skirt structure. The corner panels 424A, 424B, 428A, 428B are substantially perpendicular to the main panel 412.

FIG. 12B shows the carrier 490 after application to a group of articles, the articles B have been omitted from FIG. 12B for illustrative purposes. The corner panels 424A, 424B 428A, 428B are deformed from their initial planar shape and may adopt a generally convex shape (when viewed from an external viewpoint) as shown in FIG. 10; in doing so the length or area of a region of the corner panels 424A, 424B 428A, 428B in contact with the article B may increase. The maximum distance between a pair of diagonally opposing corner panels 424A/428B, 424B/428A increases. Portions of the corner panels 424A, 424B 428A, 428B are displaced outwardly.

Figure 13:
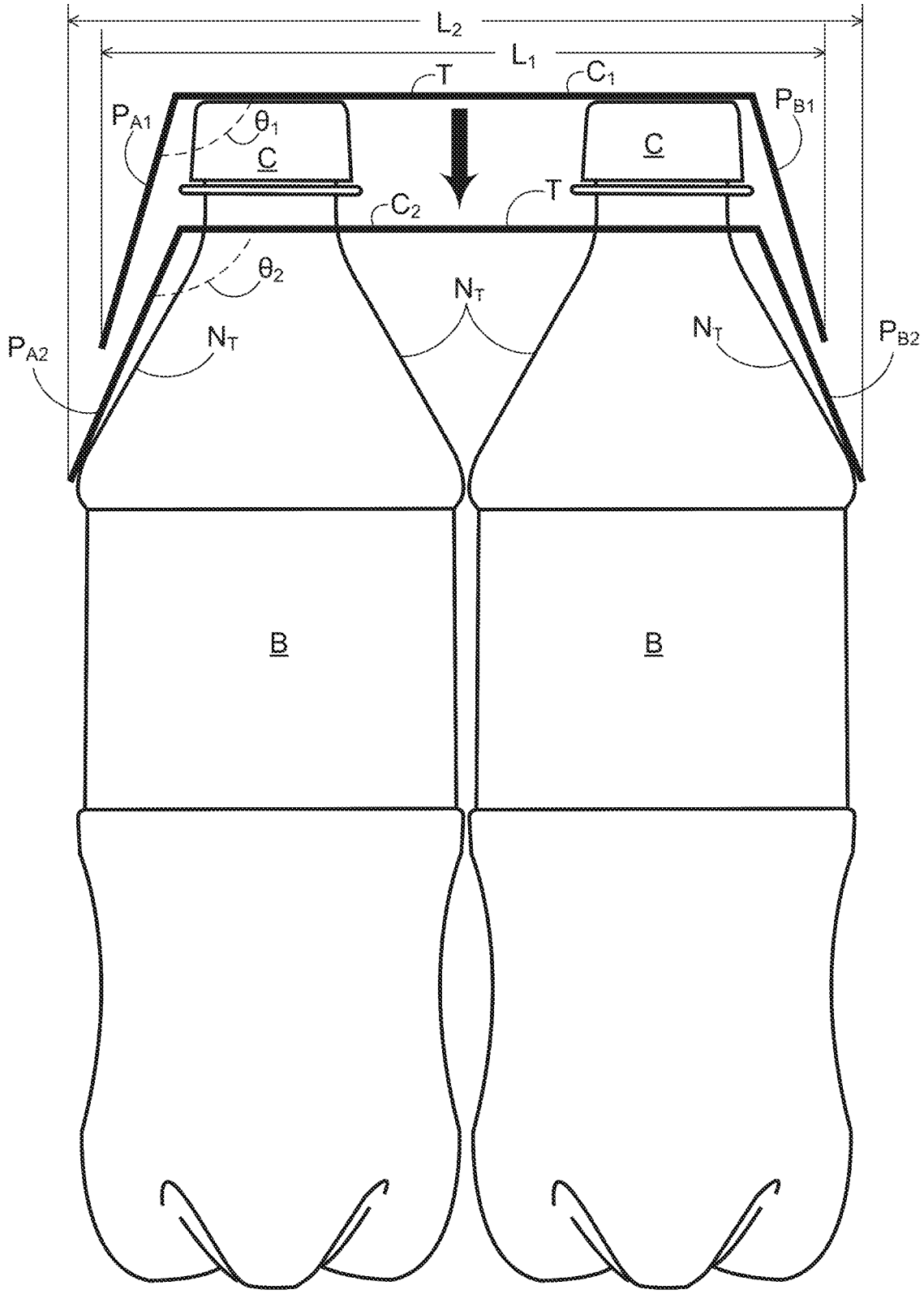
FIG. 13 schematically illustrates application of a carrier according to various embodiments to a group of articles.

FIG. 13 schematically illustrates application of a carrier 90; 190; 290; 390; 490 to a group of articles B, there is shown a carrier $C_1$ before engagement with the group of articles B and the carrier $C_2$ after engagement with the group of articles B. There is shown a top or main panel T and a pair of opposing panels $P_A$, $P_B$ before $P_{A1}$, $P_{B1}$ and after $P_{A2}$, $P_{B2}$ engagement. The maximum distance between the pair of opposing panels $P_A$, $P_B$ increases from a first dimension or length $L_1$ to a second, greater dimension or length $L_2$. The pair of opposing panels $P_A$, $P_B$ may be a pair of opposing end panels, a pair of opposing side panels or a pair of opposing corner panels.

The pair of opposing panels $P_A$, $P_B$ are the first panels of the skirt structure, of which the pair of opposing panels $P_A$, $P_B$ form a part, to contact the sidewall, neck or shoulders NT of the articles B. The neck or shoulder is tapered in shape such that the article B increase in diameter or width as it approaches a main body of the article B.

When the carrier $C_1$ is applied to the articles B, the angle of inclination of the pair of opposing panels $P_A$, $P_B$ with respect to the main panel T changes. An internal angle defined between the main panel T and a respective one of the pair of opposing panels $P_A$, $P_B$ changes from $\theta_1$ to $\theta_2$. When the pair of opposing panels $P_A$, $P_B$ are a pair of opposing end panels or a pair of opposing side panels, $\theta_2$ may be greater than $\theta_1$. When the pair of opposing panels $P_A$, $P_B$ are a pair of opposing corner panels, the angles $\theta_1$, $\theta_2$ each may refer to the internal angles between the main panel T and one of the pairs of opposing side and end panels and $\theta_2$ may be less than $\theta_1$.

Figures 14A, 14B, 14C, 14D:
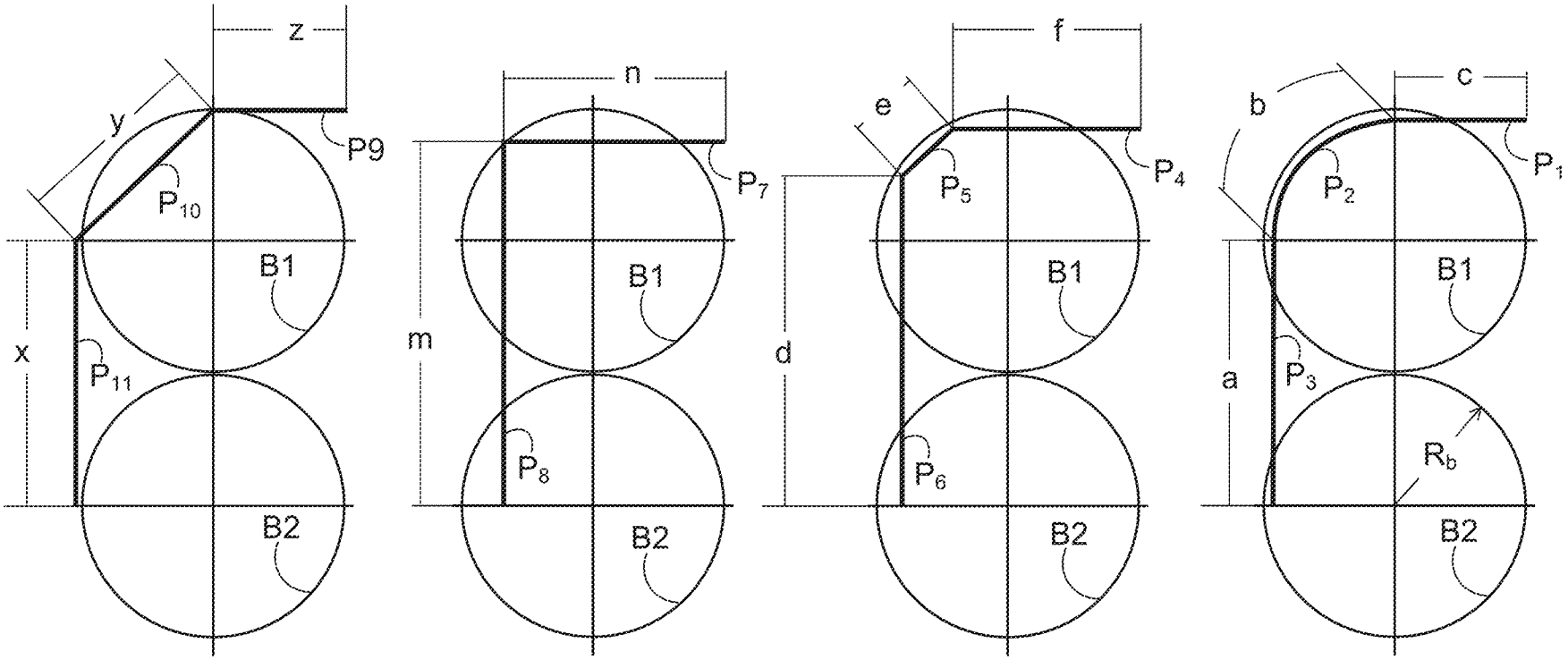
FIGS. 14A to 14C schematically illustrates a carrier according to various embodiments prior to a group of articles.
FIG. 14D schematically illustrates a carrier according to various embodiments after application to a group of articles.

FIGS. 14A to 14C show a variety of panel configurations for use with the blanks 10; 110; 210; 310; 410 and carriers 90; 190; 290; 390; 490 of the present disclosure; for illustrative purposes only a portion of the panels is shown, also shown is a pair of articles B1, B2 with which the portion of the panels engages. FIGS. 14A, 14B and 14C schematically show the skirt structures of carriers of different embodiments in their pre-loading forms. Each of FIGS. 14A, 14B and 14C shows an initial 2-dimensional configuration or arrangement of the panels of the respective skirt structure in a pre-loading form in which the skirt structure may sit on the group of articles B1, B2 but otherwise is free of circumferential tension. The line segments P4, P5, P6 in FIG. 14C schematically illustrate a horizontal cross section of a corner portion of the skirt structure of a pre- or non-loaded carrier such as one of the carriers 90 and 190 in FIGS. 2 and 4 having a corner panel P5. The line segments P7, P8 in FIG. 14B schematically illustrate a horizontal cross section of a corner portion of the skirt structure of a pre- or non-loaded carrier such as the carrier 290 in FIG. 6 having no corner panel. The line segments P9, P10, P11 in FIG. 14A schematically illustrate a horizontal cross section of a corner portion of the skirt structure of a pre- or non-loaded carrier such as one of the carriers 390 and 490 in FIGS. 8 and 12A having a corner panel P10. FIG. 14D shows a target or desired 2-dimensional, post-loading configuration or arrangement of the panels of the skirt structure of each of the carriers in FIGS. 14A, 14B, 14C. In FIG. 14D, the post-loaded skirt structure tightly fits around a group of articles B1, B2 and thereby undergoes circumferential tension. The line segments P1, P2, P3 schematically illustrate a horizontal cross section of a corner portion of the tensioned skirt structure along the contacting points between the skirt structure and the articles B1, B2.

In the desired configuration or post-loading form, a portion $P_2$ of the perimeter of the skirt structure is shaped to conform to the perimeter of the article B1. The adjacent portions $P_1$ and $P_3$ extend between one article B1, B2 and an adjacent neighbouring article B1, B2, and may be generally planar.

In the embodiment illustrated in FIG. 14A, the panels $P_9$ and $P_{11}$ are configured to avoid initial contact with the articles B1, B2 when the carrier is first lowered. The panel $P_{10}$, which may be a corner panel, makes initial contact with the endmost article B1 when the carrier is first lowered. As the carrier is further lowered, the panel $P_{10}$ is thrust into contact at its inside surface with the article B1 so that at least a portion of the panel $P_{10}$ is pushed outwardly. This has the effect of pulling the adjacent panels $P_9$ and $P_{11}$ inwardly. These panels $P_9$ and $P_{11}$ subsequently contact the articles B1, B2, effectively tightening the carrier about the article group. Panel $P_{10}$ may be a corner panel 324A, 324B, 328A, 328B; 424A, 424B, 428A, 428B such as that shown in FIGS. 7 to 12B and described above.

The skirt structure of the carrier may extend beyond or below the contact point illustrated in FIG. 14D, which is shown in FIG. 13, wherein the inner surface of the opposing panels $P_{A2}$, $P_{B2}$ of the skirt structure is in contact with the shoulders of the articles B, and the lowermost edges of the panels $P_{A2}$, $P_{B2}$ are disposed below the contact point.

Figure 15:
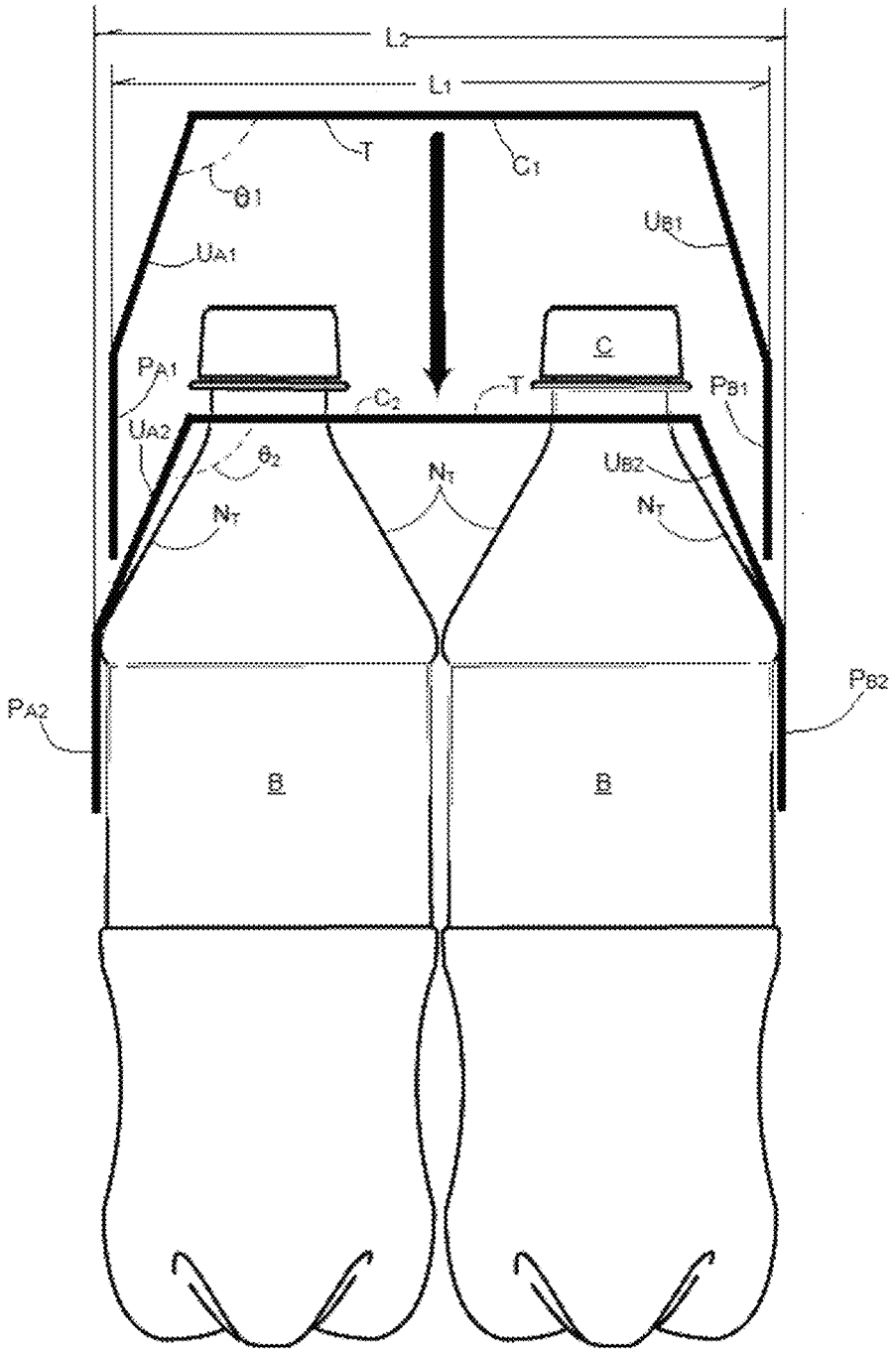
FIG. 15 schematically illustrates application of a carrier according to the embodiments of FIGS. 3, 4, 11, 12A and 12B to a group of articles.

Another example in which the skirt structure of the carrier extends beyond or below the contact point is shown in FIG. 15 wherein the inner surface of the opposing sloping upper panels $U_{A2}$, $U_{B2}$ of the skirt structure may, or may not, be in contact with the shoulders of the articles B, and the opposing lower panels $P_{A2}$, $P_{B2}$ of the skirt structure extend downwards below the lowermost edges of the upper panels $P_{A2}$, $P_{B2}$ and may be brought into contact with the main body portions of the articles when the carrier is in the post-loading form. The opposing sloping upper panels $U_{A2}$, $U_{B2}$ may be brought into contact with the body portions of the articles B when the carrier is in the post-loading form.

FIG. 15 schematically illustrates, for example, application of a carrier 190 or 490 (shown in FIGS. 3, 4, 11, 12A and 12B) to a group of articles B, there is shown a carrier $C_1$ before engagement with the group of articles B and the carrier $C_2$ after engagement with the group of articles B. There is shown a top or main panel T and a pair of opposing panels $P_A$, $P_B$ before $P_{A1}$, $P_{B1}$ and after $P_{A2}$, $P_{B2}$ engagement. The maximum distance between the pair of opposing panels $P_A$, $P_B$ increases from a first dimension or length $L_1$ to a second, greater dimension or length $L_2$. The pair of opposing panels $P_A$, $P_B$ may be a pair of opposing end panels, a pair of opposing side panels or a pair of opposing corner panels.

The pair of opposing panels $P_A$, $P_B$ are the first panels of the skirt structure, of which the pair of opposing panels $P_A$, $P_B$ form a part, to contact the generally cylindrical main body, sidewall or shoulders NT of the articles B. The neck or shoulder is tapered in shape such that the article B increase in diameter or width as it approaches a main body of the article B.

When the carrier $C_1$ is applied to the articles B, the angle of inclination of the pair of opposing upper panels $U_A$, $U_B$ with respect to the main panel T changes. An internal angle defined between the main panel T and a respective one of the pair of opposing upper panels $U_A$, $U_B$ changes from $\theta_1$ to $\theta_2$. When the pair of opposing lower panels $P_A$, $P_B$ are a pair of opposing end panels or a pair of opposing side panels, $\theta_2$ may be greater than $\theta_1$. When the pair of opposing lower panels $P_A$, $P_B$ are a pair of opposing corner panels, the angles $\theta_1$, $\theta_2$ each may refer to the internal angles between the main panel T and one of the pairs of opposing upper side and end panels and $\theta_2$ may be less than $\theta_1$.

In the embodiment illustrated in FIG. 14B, a pair of panels $P_7$, $P_8$ form a square corner of a carrier. One or both of the pair of panels $P_7$, $P_8$ is configured to make initial contact with the articles B1, B2 when the carrier is lowered. The panel $P_7$ and/or panel $P_8$ are forced outwardly and a portion of each panel $P_7$, $P_8$ is deformed to conform to a perimeter region of the end or corner article B1 while the squared corner is drawn inwardly about the article B1. The embodiment shown in FIGS. 5 and 6 and described above may interact with the articles B1, B2 in the manner shown in FIG. 14B.

In the embodiment illustrated in FIG. 14C a three panels $P_4$, $P_5$, $P_6$ form a chamfered or bevelled corner of a carrier. The chamfered corner panels are smaller or narrower in the horizontal dimension than those of the carrier illustrated in FIG. 14A. As a consequence, the corner panel $P_5$ does not make the initial contact with the articles B1, B2; rather, one or both of the end or side panels $P_4$, $P_6$ make initial contact. In doing so, the end or side panels $P_4$, $P_6$ are forced outwardly and the corner panel $P_5$ is drawn inwardly until the panel configuration adopts a shape similar or approaching that shown in FIG. 14D.

In the arrangement shown in FIG. 14D the perimeter comprises a portion P1 having a length c, a portion P2 having a length b and a portion P3 having a length a, the total length of the perimeter illustrated is the sum of length a, length b, and length c.

The length of the portions of the panels shown in each of FIGS. 14A, 14B and 14C remains constant, that is to say, it remains the same after application of the panels to the articles B, therefor:

$$a+b+c=d+e+f$$

$$a+b+c=n+m$$

$$a+b+c=x+y+z$$

where f, e, d, n, m, z, y, x is the length of the panel $P_4$, $P_5$, $P_6$, $P_7$, $P_8$, $P_9$, $P_{10}$, $P_{11}$ respectively.

The blanks 10; 110; 210; 310; 410 include at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). Examples of such a substrate are: 27 point (pt.) SBS board (solid bleached sulphate paperboard coated on one side, trade name PrintKote®) or CNK® board (Coated Natural Kraft®—an unbleached kraft paperboard having a clay coating on one side, trade name CarrierKote™); 21 point (pt.) SBS board or CNK® board; and E flute or F flute corrugated fibreboard, manufactured by WestRock® Company. The paperboard substrate may be a bleached or unbleached board. The board may be coated on at least one side, optionally the side opposite the lamination, with a conventional coating selected for compatibility with the printing method and board composition.

The blanks 10; 110; 210; 310; 410 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g., MYLAR®, which is a bi-axially oriented polyester, oriented nylon, cross-laminated polyolefin or high-density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

The present disclosure provides a carrier of the top engaging type having improved article retention structures or article top engaging devices.

Embodiments provide an article retention structure RT1, RT2 in a main, top, or engaging panel 12; 112; 212; 312; 412 having a plurality of tabs 40, 42, 44, 46, 70, 72, 74, 76; 140, 142, 144, 146, 170, 172, 174, 176; 240, 242, 244, 246, 270, 272, 274, 276; 340, 342, 346, 270, 376; 440, 442, 470, 472 disposed about an article receiving aperture A1, A2; A4, A5.

The article carrier 90; 190; 290; 390; 490 comprises a top or engaging panel 12; 112; 212; 312; 412 and a skirt structure surrounding and extending from the top panel 12; 112; 212; 312; 412, the skirt structure comprises a plurality of panels 14, 16, 18, 20, 24A, 24B, 28A, 28B; 114A, 114B, 116A, 116B, 118A, 118B, 120A, 120B, 124A, 124B, 128A, 128B; 214, 216, 218, 220; 314, 316, 318, 320, 324A, 324B, 328A, 328B; 414A, 414B, 416A, 416B, 418A, 418B, 420A, 420B, 424A, 424B, 428A, 428B.

In some embodiments one or both of a longitudinal dimension and a lateral dimension decreases after loading the carrier 90; 190; 290; 390; 490 with articles B. In other embodiments a diagonal dimension or distance between the diagonally opposing corner panels increases after the loading. The change in dimension or shape of the skirt structure has the effect of increasing the circumferential tension in the skirt structure after application to the articles B so as to tightly bundle or restrain the articles B within the group of articles. The increase in circumferential tension, may in turn, induce an upward force on the carrier 90; 190; 290; 390; 490 such that engaging teeth or tabs 40, 42, 44, 46, 70, 72, 74, 76; 140, 142, 144, 146, 170, 172, 174, 176; 240, 242, 244, 246, 270, 272, 274, 276; 340, 342, 346, 270, 376; 440, 442, 470, 472 are tightly pressed against an underside of a feature of the article B such as an end closure, caps or neck flange.

Embodiments also provide an article carrier 90; 190; 290; 390; 490 comprising a top panel 12; 112; 212; 312; 412 and a skirt structure surrounding and extending from the top panel 12; 112; 212; 312; 412. The skirt structure comprises a plurality of panels 14, 16, 18, 20, 24A, 24B, 28A, 28B; 114A, 114B, 116A, 116B, 118A, 118B, 120A, 120B, 124A, 124B, 128A, 128B; 214, 216, 218, 220; 314, 316, 318, 320, 324A, 324B, 328A, 328B; 414A, 414B, 416A, 416B, 418A, 418B, 420A, 420B, 424A, 424B, 428A, 428B which include at least a first pair of opposing panels $P_{A1}$, $P_{B1}$, $P_{A2}$, $P_{B2}$. The plurality of panels 14, 16, 18, 20, 24A, 24B, 28A, 28B; 114A, 114B, 116A, 116B, 118A, 118B, 120A, 120B, 124A, 124B, 128A, 128B; 214, 216, 218, 220; 314, 316, 318, 320, 324A, 324B, 328A, 328B; 414A, 414B, 416A, 416B, 418A, 418B, 420A, 420B, 424A, 424B, 428A, 428B are connected together such that the skirt structure provides a continuous loop for surrounding a group of articles to bundle the articles B of the group together. The pair of opposing panels $P_{A1}$, $P_{B1}$, $P_{A2}$, $P_{B2}$ extend from the top panel 12; 112; 212; 312; 412 to respective distal ends thereof such that the opposing panels $P_{A1}$, $P_{B1}$, $P_{A2}$, $P_{B2}$ diverge away from each other as they extend away from the top panel 12; 112; 212; 312; 412. The skirt structure has a pre-loading form before application to the group of articles and a post-loading form in which articles are received by the skirt structure. The skirt structure in the pre-loading form has a first pre-loading dimension or length $L_1$ measured between distal ends of the opposing panels $P_{A1}$, $P_{B1}$. The skirt structure in the post-loading form has a first post-loading length $L_2$ measured between the distal ends of the opposing panels $P_{A2}$, $P_{B2}$. The post-loading form differs from the pre-loading form such that the first post-loading length $L_2$ is greater than the first pre-loading length $L_1$.

In some embodiments, the plurality of panels 14, 16, 18, 20, 24A, 24B, 28A, 28B; 114A, 114B, 116A, 116B, 118A, 118B, 120A, 120B, 124A, 124B, 128A, 128B; 214, 216, 218, 220; 314, 316, 318, 320, 324A, 324B, 328A, 328B; 414A, 414B, 416A, 416B, 418A, 418B, 420A, 420B, 424A, 424B, 428A, 428B includes a pair of opposing end panels 14, 16; 114A, 114B, 116A, 116B; 214, 216; 314, 316; 414A, 414B, 416A, 416B and a pair of opposing side panels 18, 20; 118A, 118B, 120A, 120B; 218, 220; 318, 320; 418A, 418B, 420A, 420B, wherein the opposing panels $P_{A1}$, $P_{B1}$, $P_{A2}$, $P_{B2}$ of the first pair comprises the opposing end panels 14, 16; 114A, 114B, 116A, 116B; 214, 216; 314, 316; 414A, 414B, 416A, 416B.

In some embodiments, the plurality of panels 14, 16, 18, 20, 24A, 24B, 28A, 28B; 114A, 114B, 116A, 116B, 118A, 118B, 120A, 120B, 124A, 124B, 128A, 128B; 214, 216, 218, 220; 314, 316, 318, 320, 324A, 324B, 328A, 328B; 414A, 414B, 416A, 416B, 418A, 418B, 420A, 420B, 424A, 424B, 428A, 428B includes a pair of opposing end panels 14, 16; 114A, 114B, 116A, 116B; 214, 216; 314, 316; 414A, 414B, 416A, 416B, a pair of opposing side panels 18, 20; 118A, 118B, 120A, 120B; 218, 220; 318, 320; 418A, 418B, 420A, 420B and a pair of diagonally opposing corner panels 24A, 24B, 28A, 28B; 124A, 124B, 128A, 128B; 324A, 324B, 328A, 328B; 424A, 424B, 428A, 428B, wherein the opposing panels $P_{A1}$, $P_{B1}$, $P_{A2}$, $P_{B2}$ of the first pair comprise the diagonally opposing corner panels 24A, 24B, 28A, 28B; 124A, 124B, 128A, 128B; 324A, 324B, 328A, 328B; 424A, 424B, 428A, 428B.

In some embodiments, the plurality of panels 14, 16, 18, 20, 24A, 24B, 28A, 28B; 114A, 114B, 116A, 116B, 118A, 118B, 120A, 120B, 124A, 124B, 128A, 128B; 214, 216, 218, 220; 314, 316, 318, 320, 324A, 324B, 328A, 328B; 414A, 414B, 416A, 416B, 418A, 418B, 420A, 420B, 424A, 424B, 428A, 428B includes a second pair of opposing panels $P_{A1}$, $P_{B1}$, $P_{A2}$, $P_{B2}$, the opposing panels $P_{A1}$, $P_{B1}$, $P_{A2}$, $P_{B2}$ of the second pair extend from the top panel 12; 112; 212; 312; 412 to respective distal ends thereof such that the opposing panels $P_{A1}$, $P_{B1}$, $P_{A2}$, $P_{B2}$ Of the second pair diverge away from each other as they extend away from the top panel 12; 112; 212; 312; 412. The skirt structure in the pre-loading form has a second pre-loading length measured between the distal ends of the opposing panels $P_{A1}$, $P_{B1}$, $P_{A2}$, $P_{B2}$ of the second pair. The skirt structure in the post-loading form has a second post-loading length measured between the distal ends of the opposing panels $P_{A1}$, $P_{B1}$, $P_{A2}$, $P_{B2}$ of the second pair. The post-loading form differs from the pre-loading form such that the first and second post-loading lengths are greater than the first and second pre-loading lengths respectively.

It can be appreciated that various changes may be made within the scope of the present invention, for example, the size and shape of the panels and apertures may be adjusted to accommodate articles of differing size or shape, a greater or lesser number of articles and/or arranged in different array configurations.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

What is claimed is:

1. An article carrier for packaging one or more articles, the article carrier comprising a main panel and a skirt structure surrounding and extending from the main panel, the skirt structure comprising a plurality of panels including at least a first pair of opposing panels, the plurality of panels are connected together such that the skirt structure provides a continuous loop for surrounding a group of articles to bundle the articles of the group together, the first pair of opposing panels extend from the main panel to respective distal ends thereof such that the opposing panels diverge away from each other as they extend away from the main panel, wherein the skirt structure has a pre-loading form before application to the group of articles and a post-loading form after loading with articles, in which the articles are received by the skirt structure, the skirt structure in the pre-loading form has a first pre-loading length L.sub.1 measured between distal ends of the opposing panels, and wherein the skirt structure in the post-loading form has a first post-loading length L.sub.2 measured between the distal ends of the opposing panels, the post-loading form differs from the pre-loading form such that the first post-loading length L.sub.2 is greater than the first pre-loading length L.sub.1.

2. An article carrier according to claim 1, wherein the plurality of panels includes a pair of opposing end panels and a pair of opposing side panels, wherein the opposing panels of the first pair comprise the opposing end panels.

3. An article carrier according to claim 1, wherein the plurality of panels includes a pair of opposing end panels, a pair of opposing side panels and at least one pair of diagonally opposing corner panels, wherein the opposing panels of the first pair comprise the at least one pair of diagonally opposing corner panels.

4. An article carrier according to claim 1, wherein the plurality of panels includes a second pair of opposing panels, the opposing panels of the second pair extend from the main panel to respective distal ends thereof such that the opposing panels of the second pair diverge away from each other as they extend away from the main panel, the skirt structure in the pre-loading form has a second pre-loading length measured between the distal ends of the opposing of the second pair, the skirt structure in the post-loading form has a second post-loading length measured between the distal ends of the opposing panels of the second pair, the post-loading form differs from the pre-loading form such that the first and second post-loading lengths are greater than the first and second pre-loading lengths respectively.

5. An article carrier according to claim 1, wherein the article carrier is preassembled to provide the pre-loading form of the skirt structure before application to the group of articles.

6. A blank for forming an article carrier, the blank comprising a main panel and a plurality of panels for forming a skirt structure extending from the main panel for surrounding the main panel in a setup condition, the plurality of panels being configured to be connected together such that the skirt structure provides a continuous loop for surrounding a group of articles to bundle the articles of the group together, the skirt structure including at least a first pair of opposing panels extending from the main panel to respective distal ends thereof, in a setup condition the opposing panels diverge away from each other as they extend away from the main panel, wherein the skirt structure has a pre-loading form before application to the group of articles and a post-loading form after loading with articles, in which the articles are received by the skirt structure, the skirt structure in the pre-loading form has a first pre-loading length L.sub.1 measured between distal ends of the opposing panels, and wherein the skirt structure in the post-loading form has a first post-loading length L.sub.2 measured between the distal ends of the opposing panels, the post-loading form differs from the pre-loading form such that the first post-loading length L.sub.2 is greater than the first pre-loading length L.sub.1.

7. A blank for forming an article carrier according to claim 6, wherein the blank is configured to be preassembled to provide the pre-loading form of the skirt structure before application to the group of articles.

8. An article carrier for packaging one or more articles, the article carrier comprising a main panel and a skirt structure surrounding and extending from the main panel, the skirt structure comprising a plurality of panels connected together such that the skirt structure provides a continuous loop for surrounding a group of articles to bundle the articles of the group together, the plurality of panels comprising at least a pair of opposing upper panels and at least a first pair of opposing lower panels, the opposing upper panels extending from the main panel such that the opposing upper panels diverge away from each other as they extend away from the main panel, the first pair of opposing lower panels are connected to the opposing upper panels such that the first pair of opposing lower panels extend to respective distal ends thereof wherein the skirt structure has a pre-loading form before application to the group of articles and a post-loading form after loading with articles, in which the articles are received by the skirt structure, the skirt structure in the pre-loading form has a first pre-loading length L.sub.1 measured between distal ends of the opposing lower panels, and wherein the skirt structure in the post-loading form has a first post-loading length L.sub.2 measured between the distal ends of the opposing lower panels, the post-loading form differs from the pre-loading form such that the first post-loading length L.sub.2 is greater than the first pre-loading length L.sub.1.

9. An article carrier according to claim 8, wherein the plurality of panels includes a pair of opposing lower end panels and a pair of opposing lower side panels, the lower side panels and the lower end panels being connected to the at least a pair of opposing upper panels wherein the opposing lower panels of the first pair comprise the opposing lower end panels.

10. An article carrier according to claim 8, wherein the plurality of panels includes a pair of opposing lower end panels, a pair of opposing lower side panels and at least one pair of diagonally opposing corner panels, wherein the opposing lower panels of the first pair comprise the at least one pair of diagonally opposing corner panels.

11. An article carrier according to claim 8, wherein the article carrier is preassembled to provide the pre-loading form of the skirt structure before application to the group of articles.

12. A blank for forming an article carrier, the blank comprising a main panel and a plurality of panels for forming a skirt structure extending from the main panel for surrounding the main panel in a setup condition, the plurality of panels being configured to be connected together such that the skirt structure provides a continuous loop for surrounding a group of articles to bundle the articles of the group together, the plurality of panels comprising at least a pair of opposing upper panels and at least a first pair of opposing lower panels, the opposing upper panels extending from the main panel such that the opposing upper panels diverge away from each other as they extend away from the main panel, the first pair of opposing lower panels are connected to the opposing upper panels such that the first pair of opposing lower panels extend to respective distal ends thereof wherein the skirt structure has a pre-loading form before application to the group of articles and a post-loading form after loading with articles, in which the articles are received by the skirt structure, the skirt structure in the pre-loading form has a first pre-loading length L.sub.1 measured between distal ends of the opposing lower panels, and wherein the skirt structure in the post-loading form has a first post-loading length L.sub.2 measured between the distal ends of the opposing lower panels, the post-loading form differs from the pre-loading form such that the first post-loading length L.sub.2 is greater than the first pre-loading length L.sub.1.

13. A blank for forming an article carrier according to claim 12, wherein the blank is configured to be preassembled to provide the pre-loading form of the skirt structure before application to the group of articles.

* * * * *